US009803870B2

(12) United States Patent
Pedersen

(10) Patent No.: US 9,803,870 B2
(45) Date of Patent: Oct. 31, 2017

(54) METHOD FOR BURNING A FUEL IN A WOOD STOVE, A WOOD STOVE WITH A CONTROLLER; AND AN AIR REGULATOR FOR A WOOD STOVE

(71) Applicant: IHS Innovation ApS, Horning (DK)

(72) Inventor: Vagn Hvam Pedersen, Skanderborg (DK)

(73) Assignee: IHS INNOVATION APS, Horning (DK)

( * ) Notice: Subject to any disclaimer, the term of this patent is extended or adjusted under 35 U.S.C. 154(b) by 432 days.

(21) Appl. No.: 14/356,835

(22) PCT Filed: Nov. 7, 2012

(86) PCT No.: PCT/DK2012/050409

§ 371 (c)(1),
(2) Date: May 7, 2014

(87) PCT Pub. No.: WO2013/068015

PCT Pub. Date: May 16, 2013

(65) Prior Publication Data

US 2014/0315137 A1 Oct. 23, 2014

(30) Foreign Application Priority Data

Nov. 7, 2011 (DK) ..... 2011 70606

(51) Int. Cl.

| | |
|---|---|
| ***F24B 3/00*** | (2006.01) |
| ***F24B 13/00*** | (2006.01) |
| ***F23N 3/06*** | (2006.01) |
| ***F23L 3/00*** | (2006.01) |
| ***F23L 9/04*** | (2006.01) |

(Continued)

(52) U.S. Cl.

CPC ..... *F24B 13/004* (2013.01); *F23L 3/00* (2013.01); *F23L 9/04* (2013.01); *F23L 13/06* (2013.01); *F23N 3/002* (2013.01); *F23N 3/06* (2013.01); *F23N 5/006* (2013.01); *F24B 1/028* (2013.01); *F24B 5/026* (2013.01); *F23N 2035/06* (2013.01); *F23N 2037/10* (2013.01); *F23N 2037/16* (2013.01)

(58) Field of Classification Search

CPC ..... F23N 5/00
USPC ..... 431/12; 110/188; 126/77
See application file for complete search history.

(56) References Cited

U.S. PATENT DOCUMENTS 4,556,044 A 12/1985 Barsness et al.
4,643,165 A 2/1987 Chamberlain
(Continued)

FOREIGN PATENT DOCUMENTS

DE 8706650 U1 7/1987
DE 3705153 A1 9/1988
(Continued)

*Primary Examiner* — Avinash Savani
(74) *Attorney, Agent, or Firm* — Muncy, Geissler, Olds & Lowe, P.C.

(57) ABSTRACT

A method for burning a fuel in a wood stove having a door to a combustion chamber with a base, which combustion chamber is isolated from the air by an exhaust and an intake at which intake there is provided an air regulator having at least primary, secondary and tertiary air intake ducts. The stove is controlled by a burn controller configured to operate between the different operating, i.e. different combustion states.

7 Claims, 19 Drawing Sheets

(51) Int. Cl.

| | |
|---|---|
| ***F23N 3/00*** | (2006.01) |
| ***F23N 5/00*** | (2006.01) |
| ***F24B 1/02*** | (2006.01) |
| ***F24B 5/02*** | (2006.01) |
| ***F23L 13/06*** | (2006.01) |

(56) References Cited

U.S. PATENT DOCUMENTS

| | | | | |
|---|---|---|---|---|
| 4,832,000 | A | 5/1989 | Lamppa et al. | |
| 5,113,843 | A | 5/1992 | Henry et al. | |
| 5,341,794 | A | 8/1994 | Henry et al. | |
| 5,666,889 | A | 9/1997 | Evens et al. | |
| 6,595,199 | B1 | 7/2003 | Andersen et al. | |
| 2007/0289589 | A1 | 12/2007 | McFarland | |
| 2009/0211565 | A1* | 8/2009 | Dufour | F24B 1/193 126/524 |
| 2010/0229768 | A1* | 9/2010 | Enders | F23B 10/00 110/188 |

FOREIGN PATENT DOCUMENTS

| | | |
|---|---|---|
| DE | 10 2006 046599 | 9/2006 |
| DK | 166 637 | 11/1991 |
| EP | 0 604 388 | 12/1993 |
| EP | 1 918 637 | 5/2008 |
| EP | 2 085 694 A2 | 8/2009 |
| GB | 2 389 414 | 12/2003 |

* cited by examiner

| | Valve Control | | |
|---|---|---|---|
| | Initial value | PD Controller input | Setpoint value |
| Primary | 0% | None | - |
| Secondary | Unchanged | O2 | 13% O2 |
| Tertiary | 100% | Temperature | Tset |

| | Valve Control | | |
|---|---|---|---|
| | Initial value | PD Controller input | Setpoint value |
| Primary | 0% | None | - |
| Secondary | Unchanged | O2 | 11,5% O2 |
| Tertiary | 100% | Temperature | Tset |

Valve Control (180)

| | Initial value | PD Controller input | Setpoint value |
|---|---|---|---|
| Primary | Unchanged Max 50% | Temperature | Tset |
| Secondary | 0% | None | - |
| Tertiary | Unchanged Min 10% | O2 | 13% O2 |

Valve Control (181)

| | Initial value | PD Controller input | Setpoint value |
|---|---|---|---|
| Primary | 0% | Temperature | Tset |
| Secondary | 0% | None | - |
| Tertiary | Unchanged Min 10% | O2 | 11,5% O2 |

| Valve Control | Initial value | PD Controller input | Setpoint value |
|---|---|---|---|
| Primary | 0% | None | - |
| Secondary | Unchanged | O2 | 8,5 % O2 |
| Air wash (Tertiary) | 50% | None | - |

| Valve Control | Initial value | PD Controller input | Setpoint value |
|---|---|---|---|
| Primary | 0% | None | - |
| Secondary | 20% | O2 | 8,5 % O2 |
| Air wash (Tertiary) | 50% | None | - |

| Valve Control | | | |
|---|---|---|---|
| | Initial value | PD Controller input | Setpoint value |
| Primary | Unchanged Max %50 | Temperature | Tset |
| Secondary | 0% | O2 | 8,5 % O2 |
| Air wash (Tertiary) | 50% | None | - |

| Valve Control | | | |
|---|---|---|---|
| | Initial value | PD Controller input | Setpoint value |
| Primary | 0% max 50% | Temperature | Tset |
| Secondary | 0% | O2 | 8,5 % O2 |
| Air wash (Tertiary) | 50% | None | - |

| | Valve Control | | |
|---|---|---|---|
| | Initial value | PD Controller input | Setpoint value |
| Primary | Unchanged Max %50 | O2 | 8,5% |
| Secondary | 0% | O2 max | 8,5% |
| Air wash (Tertiary) | 50% | None | - |

METHOD FOR BURNING A FUEL IN A WOOD STOVE, A WOOD STOVE WITH A CONTROLLER; AND AN AIR REGULATOR FOR A WOOD STOVE

FIELD OF THE INVENTION

The present invention relates to wood stove and a method for burning a fuel in a wood stove having a door to a combustion chamber with a base, which combustion chamber is isolated from the air by an exhaust and an intake at which intake there is an air regulator having at least three valves, a primary valve connected via a primary air duct to regulate supply of primary combustion air to the combustion chamber through the base, a secondary valve connected via a secondary air duct to regulate supply of secondary combustion air to the combustion chamber between the base and the exhaust and preferably at the rear side, and a tertiary valve connected via a tertiary air duct to regulate supply of tertiary combustion air to the combustion chamber at the upper end and preferably at the front side, which three valves each are controlled by a burn controller configured to operate between the following states:

$0^{th}$ state; which is a cold start state of a burn of a fuel;

$1^{st}$ state; which is a warm start state of a burn of a fuel;

$2^{nd}$ state; which is a combustion state of a burn of a fuel;

$3^{rd}$ state; which is a glow state of a burn of a fuel;

$4^{th}$ state; which is an off state.

This invention further relates to a wood stove burn controller, a wood stove air regulator and a kit of a wood stove burn controller and a wood stove air regulator. A method for refitting a wood stove with a burn controller and a wood stove air regulator.

BACKGROUND OF THE INVENTION

Wood burning stoves for heating houses and rooms have been know and are widespread. Although they are called wood burning stoves, wood is not the only type of fuel that is used to generate heat. Other fuels such as coal, coke, briquettes, pellets or other burnable materials can be burned in a wood stove or simply a stove.

The fuel is placed in a combustion chamber, ignited and combustion air, i.e. air with some percentage of oxygen, is supplied to the chamber to allow for a burn or glow of the fuel.

A common type of wood burning stoves has a window, a door, or a door with a window on the front of the wood stove. At least there an opening for refueling the combustion chamber with fuel.

Typically the burn is tried to be controlled by regulating the flow of combustion air to the combustion chamber either by changing the openness of the door. Some wood stoves have preset settings of valves for regulating the access of combustion air to the combustion chamber.

More recent attempts have been made to actively regulate the flow of combustion air to the combustion chamber. One such attempt is disclosed in European Patent Application EP 2 085 694.

OBJECT OF THE INVENTION

An object of embodiments of the present invention is to provide means and methods that allow a wood stove to perform a more optimised burn.

An object of embodiments of the present invention is to minimise the environmental impact from burning a fuel in the wood stove. This includes a reduction in the creation of particulate matter, sod, $NO_x$, and other harmful by products from a non-optimal burn.

An object of embodiments of the present invention is to allow for an optimal burn of different types of fuel and in particular fuel of the same type, but with different conditions such as wet, normal, dry, or more refined classifications of say wood.

An object of embodiments of the present invention is to maximise the conversion of stored energy in the fuel to useful heat over a desired period of time.

An object of embodiments of the present invention is to provide means and methods that allow for an easy usage of the wood stove. Hereby is understood a reduced need to monitor, change, or otherwise charge the combustion or burn process.

An object of embodiments of the present invention is to provide a method and means for enabling an better and more efficient burn during real and varying conditions where the airflow in a chimney varies according to the specific installation, the weather conditions, where the wood changes according to availability, moist, type, where the user involvement, interest, and expertise varies or combinations thereof.

DESCRIPTION OF THE INVENTION

In a first aspect the present invention provides a method for burning a fuel in a wood stove having a door to a combustion chamber with a base, which combustion chamber is isolated from the air by an exhaust and an intake at which intake there is an air regulator having at least three valves, a primary valve connected via a primary air duct to regulate supply of primary combustion air to the combustion chamber through the base, a secondary valve connected via a secondary air duct to regulate supply of secondary combustion air to the combustion chamber between the base and the exhaust, and a tertiary valve connected via a tertiary air duct to supply tertiary combustion air to the combustion chamber at its upper end, wherein at least two of said three valves each are controlled by a burn controller configured to operate between the following states:

$0^{th}$ state; which is a cold start state of a burn of a fuel;

$1^{st}$ state; which is a warm start state of a burn of a fuel;

$2^{nd}$ state; which is a combustion state of a burn of a fuel;

$3^{rd}$ state; which is a glow state of a burn of a fuel;

$4^{th}$ state; which is an off state.

It should be understood that at least one of the valves, preferably the tertiary valve may be replaced or constituted by a fixed, non-controllable element. In its broadest sense such "valve" may simply be constituted by a duct or other passage with no air-flow control means provided therein.

Thereby a fuel can be burned according to the objectives in a controlled fashion where the burn controller adjusts the valves to perform the burn according to the states. The secondary valve and secondary air duct are preferably provided at a rear side of the stove, i.e. that side opposite to the side comprising the door, which in the present context is denoted the front side. The tertiary valve and tertiary air duct are preferably provided at the front side of the stove.

It has surprisingly been found that efficient and clean burning can be achieved by controlling only two of the three valves, preferably the primary and the secondary, while maintaining the third one, preferably the tertiary valve in a fixed position. Hence, the tertiary air duct need not be provided with a controllable valve. In case the tertiary air duct is provided with a controllable valve, it may be kept at a fixed, i.e. constant position during at least the $0^{th}$ and $1^{st}$-$3^{rd}$ states. In the fourth state, the fixed position may be maintained, or the valve in the tertiary air duct may be completely closed.

It should be understood that, when the door is closed, the exhaust and the intake provide the sole connection of the combustion chamber to the atmosphere surrounding the stove.

The burn controller can be a micro-computer with a processor, an I/O-unit, and a storage. The burn controller has means for storing and executing a burn control algorithm. A cold start of a burn is understood to be when the wood stove, the combustion chamber and/or the fuel is provided as is and typically at ambient temperature. The temperature can vary from say −40° to say +70° Celsius. Although typical room temperatures will be from a few minus degrees to a room temperature in say the twenties degrees Celsius.

In the cold state the burn controller regulates the valves so that the primary valve is 100% open, the secondary valve is 0% open (i.e. closed), and the tertiary valve is 0% open. Alternatively, the tertiary valve may maintain a fixed position in embodiments, in which the tertiary valve is not controllable or maintained at a fixed position. In such embodiments, it may for example be approximately 50% open.

When a certain temperature, say about 50° C. is detected by the thermometer, the warm state is entered.

A warm start of a burn is understood to be when the wood stove, the combustion chamber and/or the fuel is preheated or warm after a previous burn. The warm start is when the temperature is above ambient temperature and/or when the fuel is in the vicinity of an ignition temperature.

In the warm state the burn controller regulates the valve so that the primary valve is 100% open, the secondary valve is 0% open (i.e closed), and the tertiary valve is 100% open. Alternatively, the tertiary valve may maintain a fixed position in embodiments, in which the tertiary valve is not controllable or maintained at a fixed position. In such embodiments, it may for example be approximately 50% open.

When a certain increase in temperature, say about 100° C. is detected by the thermometer and a decrease in the $O_2$-level is detected, say to about 13%, the combustion state is entered.

A combustion state is understood to be when the combustion camber and/or fuel is ignited and burning and typically with a flame or at least when the gasses ignites. A flame is indicative of a combustion.

In the combustion state the burn controller regulates the valves so that the primary valve is 0% open, the secondary valve is 0% open (i.e. closed), and the tertiary valve is left unregulated or at 100% open. Alternatively, the tertiary valve may, in one combustion phase, maintain a fixed position in embodiments, in which the tertiary valve is not controllable or maintained at a fixed position. In such embodiments, it may for example be approximately 50% open. In another combustion phase, the primary valve be unchanged (0% open, i.e. closed) or maximally 50% open.

When a certain decrease in temperature, say to about 200° C. is detected by the thermometer, the glow state is entered.

A glow state is understood to be when the fuel is glowing. The glow can either be because of a lower than ignition temperature of the fuel or due to lack of oxygen. An ember is indicative of a glow.

In the glow state the burn controller regulates the valves so that the primary valve is 0% open or max 50% open, the secondary valve is 0% open (i.e. closed), and the tertiary valve is 100% open or minimum 100% open. Alternatively, the tertiary valve may maintain a fixed position in embodiments, in which the tertiary valve is not controllable or maintained at a fixed position. In such embodiments, it may for example be approximately 50% open.

When a certain decrease in temperature, say to about 50° C. is detected by the thermometer, the off state is entered.

An off state is understood to be when the conditions for either a glow or a combustion is removed. This can be achieved by removing the fuel, removing the oxygen, or by lowering the temperature of the fuel.

In the off state the burn controller regulates the valves so that the primary valve is 0% open, the secondary valve is 0% open (i.e. closed), and the tertiary valve is 10% open. Alternatively, the tertiary valve may maintain a fixed position in embodiments, in which the tertiary valve is not controllable or maintained at a fixed position. In such embodiments, it may for example be approximately 50% open. However, in order to avoid heat from the surrounding room to dissipate into the cooled-down stove through the tertiary air duct, it may be closed in the off state.

According to an embodiment the burn controller has a timer. This tinier is used at least partially to progress through the burn stages.

This timer with a time t is started when the cold start state, $0^{th}$ state, is entered. The time t in an embodiment used to change from one state to another. The valve settings can be as described, but the condition to change states is determined by the time of the timer.

According to an embodiment the burn can be coded for a particular type of fuel such as wood, woods of different types and moist and the controller performs a standard burn scenario.

It is understood that each air duct can consist of one or more channels.

It is understood that each air duct, with one or more channels, can configured so that the combustion air to be supplied can be located at different positions according to the invention. In one configuration, the air ducts spits up in multiple channels.

The person skilled in the art will according exact layout of the wood stove position the air ducts to fulfil the intentions: That primary combustion air is guided to the fuel on the base in the combustion chamber from below; that secondary combustion air is guided to the combustion chamber in the middle of the combustion chamber above the fuel and in particular above the fuel, when it has disintegrated in the glow state; and that that tertiary combustion air is guided to the combustion chamber in the vicinity of the exhaust.

In one embodiment, the ducts providing the second and tertiary combustion air are arranged to provide a natural circulation or convection in the combustion chamber.

According to another embodiment of the invention, the method is special in that it further includes a shift from said each state, $0^{th}$, $1^{st}$, $2^{nd}$, $3^{rd}$, $4^{th}$ to any other said state, $0^{th}$, $1^{st}$, $2^{nd}$, $3^{rd}$, $4^{th}$ is provided according to a logic in the burn controller.

Thereby the burn controller can control the valves according the logic provided in the controller. The logic is understood to be based on input or data or information.

According to another embodiment of the invention, the method is special in that a state or a shift between each state is controlled according to exhaust measures provided by exhaust measure means or in inputs provided from a user interface means.

According to this embodiment, the burn controller receives data from exhaust measure means such as a thermometer and an $O_2$-measuring devices such as a λ-probe or any other equivalent means $CO_2$.

The burn controller can have a thermostatic controller that processes temperature data. The exhaust measure means or sensors are placed at the exhaust and in one embodiment in the vicinity of the combustion chamber. The exact location can vary and a person skilled in the art will need to adjust the position according to the wood stove, the fuels in mind and the actual burn characteristics of the wood stove. Typical temperature ranges during operation will in practice be between some −40° C. to say 500° C.

In an embodiment, the measure means or sensors can be placed in the combustion chamber.

The logic and the controls can be based on tabulated values and controllers selected from a range of available controllers including Proportional-Derivative (PD) controllers.

According to another embodiment of the invention, the method is special in that a state and/or a shift between each state are controlled according to an output from a door status means.

The door status means can be a contact or a detector that measures a temperature drop or change in oxygen level or a like. The door status means can be a on/off detector or open/closed detector or a continuous scale detector indicating if the door is open between 0 to 100%.

According to an embodiment each state is programmed as control schemes: a cold start control, a warm start control, a combustion control, a glow control, and an off control.

Each control is coded in the burn controller as a control scheme.

In an embodiment each control has at least one valve control scheme for each valve has an initial value setting, a PD controller input and a set point value. That is each control scheme has a primary, a secondary, and a tertiary initial value, a PD controller input, and a set point value for controlling each primary, secondary, and tertiary value, respectively.

In an embodiment the cold start control has at least a cold start valve control scheme.

In an embodiment the warm start control has at least a warm start valve control scheme.

In an embodiment, the warm start control has a logic controlling the entry to each warm start valve control schemes. This logic can be configured to be based on histories of previous states, number of times in each state, time, or external inputs from example a exhaust measure means, a door detection means or a user interface.

As such there can be a cold to warm valve control scheme, a combustion to warm valve control scheme, and a glow to warm valve control scheme.

In an embodiment the combustion control has at least one combustion valve control scheme.

In an embodiment, the combustion control has a logic controlling the entry to each combustion valve control schemes. The logic can be configured to be based on histories of previous states, time, number of times in each state, or external inputs from example an exhaust measure means, a door detection means or a user interface.

As such there can be a first warm to combustion valve control scheme and a subsequent warm to combustion valve control scheme, and a glow to warm valve control scheme.

There can a glow control with at least one glow valve control scheme.

In an embodiment, the glow control has a logic controlling the entry to each glow valve control schemes. The logic can be configured to be based on histories of previous states, time, number of times in each state, or external inputs from example a exhaust measure means, a door detection means or a user interface.

As such there can be a warm to glow value control scheme and a combustion to glow valve control scheme.

There can be an off control with at least one off control scheme.

In an embodiment, the off control has a logic controlling the entry to each glow valve control schemes. The logic can be configured to be based on histories of previous states, time, number of times in each state, or external inputs from example a exhaust measure means, a door detection means or a user interface.

Each initial value of the valve setting can be expressed as a percentage of the valve openness.

Each PD controller input can be a Temperature, an Oxygen level, a door status measure, a time, and so forth.

Each set point value can be Temperature, an Oxygen level, and so forth.

It is implicitly understood that these values will need to be adjusted, calibrated according to the specifics of a particular wood stove and its configuration. A person skilled in the art will be inspired by the disclosure of principles and starting points in this reference and will there from be enabled to explore, experiment and adjust before exact optimal values are achieved.

According to another embodiment of the invention, the method is special in that the shift from one state to another state is activated

- from the 4th state to the 0th state: when a start instruction is given; at which time a timer is reset and started to give a time t;
- from the 0th state to the 0th state: when a door open status is detected by the door status means;
- from the 0th state to the 1st state: when the $O_2$ level decreases to below between 20% to 14%, and preferably about 15%;
- from the 1st state 103 to the 1st state 103: when a door open status is detected by the door status means;
- from the $1^{st}$ state to the $2^{nd}$ state: when the T-measurement is above a $T_{set}$ plus a T-offset, where the T-offset is between 0-50° C., and preferably about 5° C.; or when the primary valve is between 0 to 10%, and preferably about 0%;
- from the 1st state to the 3rd state: when the time t ( ) is larger than between 5 to 20 min, and preferably about 15 min and the tertiary valve is between 0 to 10%, and preferably about 0%;
- from the 2nd state to the $1^{st}$ state: when a door open status is detected by the door status means, or when the T-measurement is below $T_{set}$ minus a T-offset, where the T-offset is between 0-50° C., and preferably about 15° C.;
- from the 2nd state to the 3rd state: when the time t is larger than between 5 to 20 min; and preferably about 15 min, and the tertiary valve is between 0 to 10%, and preferably about 0%;
- from the 3rd state to the 1st state: when a door open status is detected by the door status means;
- from the 3rd state to the 4th state: when the $O_2$ level increases to above between 14% and 20%, and preferably about 17.5%.

Thereby specific controls and values are provided within which a burn according to the invention is achieved.

These intervals are suitable for a wood stove with a capacity of about 2-5 kW with an air regulator as disclosed herein and with exhaust measure means placed in the exhaust in the vicinity of the combustion chamber.

Values and ranges can and will change with different configurations, but a person skilled in the art will seek use these ranges and values as starting points for experimentation and scaling.

In a further aspect, the present invention provides a wood stove having a door to a combustion chamber with a base, which combustion chamber is isolated from the air by an exhaust and an intake at which intake there is an air regulator having at least three valves, a primary valve connected via a primary air duct to regulate supply of primary combustion air to the combustion chamber through the base, a secondary valve connected via a secondary air duct to regulate supply of tertiary combustion air to the combustion chamber between the base and the exhaust, and a tertiary valve connected via a tertiary air duct to supply tertiary combustion air to the combustion chamber at its upper end, wherein at least two of said three valves each are controlled via an intake control by a burn controller that is configured to manage at least five burn states of the wood stove.

Each element or features is according to the disclosure in this reference.

According to an embodiment, the wood stove is special in that said exhaust measure means is at least a thermometer and/or a $O_2$-measuring device such as a λ-probe.

The exhaust measure means can be placed in the exhaust of the wood stove. In alternative embodiments, the exhaust measure means can be placed in the combustion chamber or further down the stream in a chimney connected to the exhaust.

In these cases different sensors can be chosen according to the actual temperature ranges.

An object of the invention is achieved by a wood stove burn controller comprising means for receiving inputs from exhaust measure means and/or a user interface and means for sending outputs to an air regulator, which outputs are generated by a burn control algorithm comprising a state machine with five burn states:

$0^{th}$ state; which is a cold start state of a burn of a fuel;

$1^{st}$ state; which is a warm start state of a burn of a fuel;

$2^{nd}$ state; which is a combustion state of a burn of a fuel;

$3^{rd}$ state; which is a glow state of a burn of a fuel;

$4^{th}$ state; which is an off state.

Thereby a controller according to the features disclosed herein is provided, which controller can be fitted to an existing wood stove with an air regulator. Which air regulator has valves as disclosed herein.

According to an embodiment, the wood stove burn controller is special in that the burn control algorithm is further configured for performing a shift from said each state: $0^{th}$, $1^{st}$, $2^{nd}$, $3^{rd}$, $4^{th}$ to any other said state: $0^{th}$, $1^{st}$, $2^{nd}$, $3^{rd}$, $4^{th}$.

Thereby the controller according to the features disclosed herein is capable of changing between each state. It is understood that each state is configured to store and execute a control as disclosed. The configuration can be done by programming the controller to have control valve schemes and logic as described. It is understood that means for programming, storing the program and/or editing the program are provided.

An object of the invention is achieved by a wood stove air regulator comprising at least one valve and preferably three valves and with a housing configured for fitting into a wood stove and configured for receiving control signals from a burn controller.

Thereby an air regulator according to the features disclosed herein is provide, which air regulator can be fitted in an existing wood stove with a burn controller configured according to the air controller and the wood stove.

According to an embodiment of the air regulator according to the invention, the air regulator is special in that the valve is a cylindrical valve with a valve piston and actuation means for linearly positioning the valve piston relatively to a valve port frame for controlling the flow of combustion air through a valve port.

Thereby the opening and the air flow through can be controlled in an optimal and easy fashion.

In particular the valve actuator means can be a motor, a continuous or stepping motor can via a spindle position the piston relative to a port in a linear fashion thereby easily converting outputs from the controller to actual positions that controls the flow through the valve.

The valve opening is 0% when the port is closed and 100% when the port is fully opened. This can be when the piston is in one extreme position (0%) and in another extreme position (100%).

A person skilled in the art will find that some calibration is needed as the flow through the valve will vary according to the resistance in the chimney and the actual positioning of the air regulator in the wood stove and the size of the inlet port.

According to an embodiment of the air regulator according to the invention, the air regulator is special in that said valve port frame is formed with a wide opening towards the end where the valve piston is in the 100% open position and with a narrower opening towards the end where the valve piston is in the closed position.

Thereby the linear movement of the piston along the port frame will result in an decreasing, such as quadratic, exponential or alike characteristics allowing for a finer regulation of the air flow through the valve at smaller opening sizes.

Thereby the air regulator can more precisely control the flow of combustion air.

An object of the invention is achieved by a kit comprising a wood stove burn controller according to the disclosure herein, an air regulator according to the disclosure herein, and exhaust measure means such as a thermometer and a $O_2$ measurement means such as a λ-probe.

Thereby means for refitting an existing wood stove are provided thereby achieving an objective of the invention.

According to an embodiment of the invention the kit is special that the kit further comprises a user interface. Thereby the wood stove can be controlled either on the wood stove or remotely via some wired or wireless communication means.

An object of the invention is achieved by a method for producing a wood stove comprising the steps:

a wood stove is provided and prepared for installing:

an air regulator according to disclosures herein, which air regulator is fitted into the wood stove;

a burn controller according to disclosures herein, which burn controller is fitted into the wood stove;

exhaust measure means are fitted to the wood stove or the chimney to the wood stove;

the air regulator is connected to the burn controller;

the exhaust measure means are connected to the burn controller.

Thereby a wood stove can be made based on existing wood stove with a lower efficiency to become an upgraded wood stove that achieves an objective of the invention.

According to an embodiment of the method for producing a wood stove, the method is further special in that it comprises a step of providing a user interface and connecting the user interface to the burn controller.

DESCRIPTION OF THE DRAWINGS

The invention is described with reference to the drawings, wherein.

Detailed Description of the Invention

| No | Part |
|---|---|
| 1 | Wood stove |
| 2 | Burn Controller |
| 3 | Exhaust |
| 4 | Exhaust measure means |
| 4' | Thermometer, T-measurement |
| 4" | λ-probe, $O_2$ measurement |
| 5 | Intake |
| 6 | Intake control |
| 6' | Primary valve control |
| 6" | Secondary valve control |
| 6"' | Tertiary valve control |
| 7 | Burn Control Algorithm |
| 8 | Valve controllers |
| 9 | Door status means |
| 10 | Thermostatic controller |
| 11 | User interface |
| 12 | User interface communication means |
| 13 | Door |
| 14 | Combustion chamber |
| 15 | Base |
| 16 | Combustion air |
| 17 | Air regulator |
| 18 | Flue gas Exhaust |
| 19 | Valves |
| 19' | Primary valve |
| 19" | Secondary valve |
| 19"' | Tertiary valve |
| 20 | Air duct |
| 20' | Primary air duct |
| 20" | Secondary air duct |
| 20"' | Tertiary air duct |
| 21 | Chimney |
| 100 | Start instruction |
| 101 | $4^{th}$ State or Off State |
| 102 | 0th State or Cold Start State |
| 103 | $1^{st}$ State or Warm Start state |
| 104 | $2^{nd}$ State or Combustion State |
| 105 | $3^{rd}$ State or Glow State |
| 110 | Initialisation |
| 111 | 4-1 shift or Start to Cold shift |
| 112 | 0-0 shift or Cold to Warm shift |
| 113 | 0-1 shift or Cold to Warm Shift |
| 114 | 1-1 shift or Warm to Warm Shift |
| 115 | 1-2 shift or Warm to Combustion shift |
| 116 | 1-3 shift or Warm to Glow shift |
| 117 | 2-1 shift or Combustion to Warm Shift |
| 118 | 2-3 shift or Combustion to Glow Shift |
| 119 | 3-1 shift or Glow to Warm shift |
| 120 | 3-4 shift or Glow to off shift |
| 130 | Cold start control |
| 131 | Warm start control |
| 132 | Combustion control |
| 133 | Glow control |
| 134 | Off control |
| 150 | Cold start valve control scheme |
| 151 | Initial value |
| 151' | Primary Initial Value |
| 151" | Secondary Initial value |
| 151"' | Tertiary Initial value |
| 152 | Controller input |
| 152' | Primary controller input |
| 152" | Secondary controller input |
| 152"' | Tertiary controller input |
| 153 | Set Point Value |
| 153' | Primary Set Point Value |
| 153" | Secondary Set Point Value |
| 153"' | Tertiary Set Point Value |
| 160 | Cold to Warm Valve control scheme |
| 161 | Combustion to Warm Valve control scheme |
| 162 | Glow to Warm Valve control scheme |
| 170 | First Warm to Combustion Valve control Scheme |
| 171 | Subsequent Warm to Combustion Valve control scheme |
| 180 | Warm Start to Glow Valve control Scheme |
| 181 | Combustion to Glow Valve Control Scheme |
| 190 | OFF valve control scheme |
| 200 | Housing |
| 201 | Intake connection means |

-continued

| Detailed Description of the Invention | |
|---|---|
| No | Part |
| 202 | Air duct connection means |
| 210 | Cylindrical valve |
| 211 | Valve housing |
| 212 | Valve piston |
| 213 | Actuator Connector |
| 214 | Actuator Means |
| 215 | Valve port |
| 216 | Valve port frame |

Figure 1:
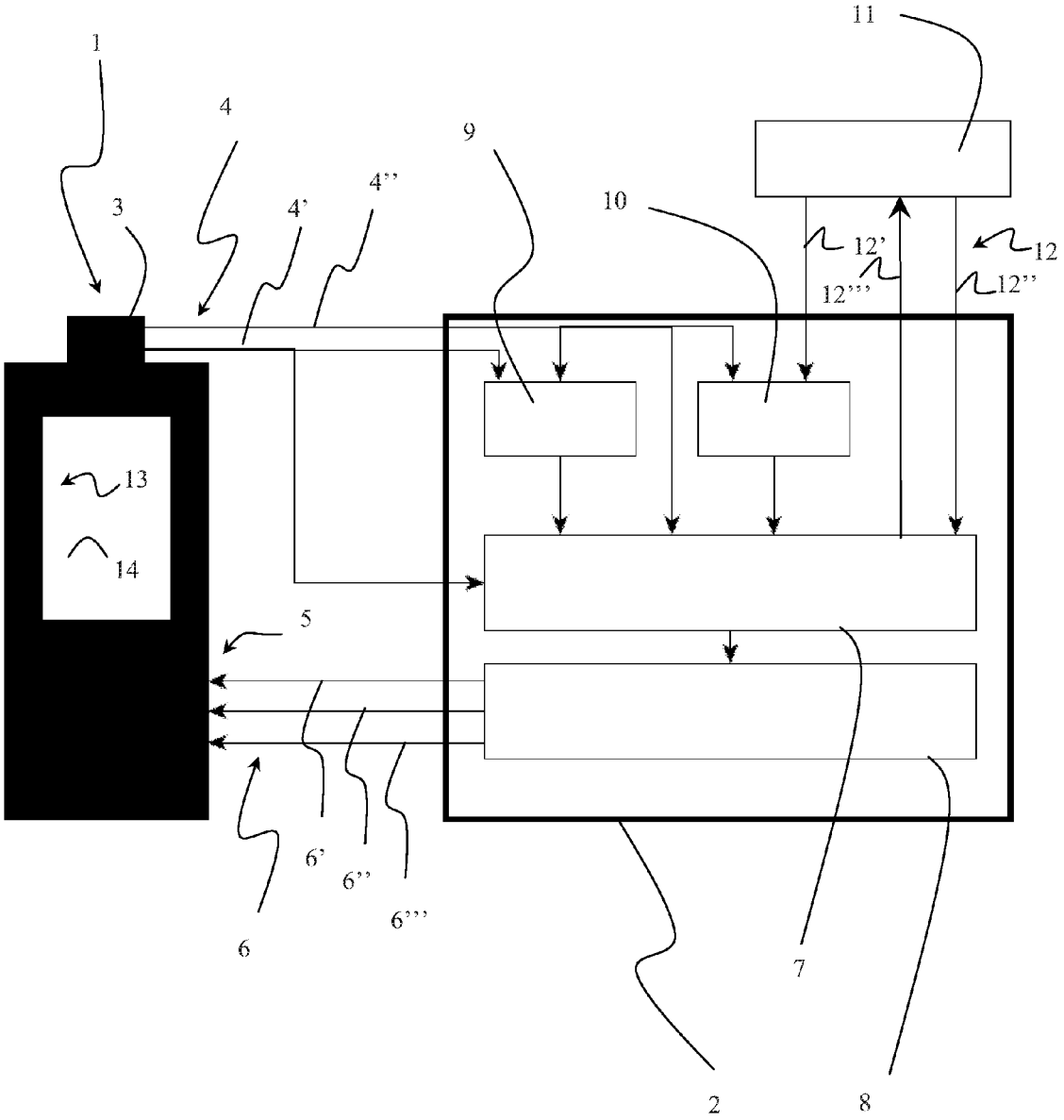
FIG. 1 shows a stove with a controller for controlling the burning in the stove.

FIG. 1 shows a schematic of wood stove 1 with a burn controller 2 for controlling a burn in the wood stove 1. The wood stove 1 has an exhaust 3 that is equipped with exhaust measure means 4 such as a thermometer 4" and such as a $O_2$ measuring means 4" like a λ-probe. The exhaust 3 is located at the upper end of the wood stove 1.

The measuring means 4 are connected to the burn controller 2.

The wood stove 1 has an intake 5 configured to supply air to the wood stove 1. The intake is located at the lower end of the wood stove 1. The intake 5 is controlled by an intake control 6 from the burn controller 2. The intake control in this embodiment has a primary valve control 6', a secondary valve control 6", and a tertiary valve control 6'''.

The burn controller 2 has means for storing and executing a burn control algorithm 7 which controls valve controllers 8.

In this embodiment the burn controller 2 has a wood stove door status means 9 configured to receive input about weather a door 13 is open or closed.

The burn controller 2 has a thermostatic controller 10 configured to receive input from the thermometer 4' and from a user interface 11 via some user interface communication means 12.

The burn controller 2 and the user interface 11 are configured to send and receive signals.

A first signal 12' is a desired temperature or burn level entered via the user interface 11.

A second signal 12" is a start or stop signal entered via the user interface 11.

A third signal 12''' is a refill signal send from the burn controller 2 to the user interface 11, which refill signal informs that more fuel is needed to maintain the desired temperature or burn cleanliness.

The wood stove 1 in this embodiment has a door 13 which in this case is a window in front of a combustion chamber 14.

Figure 2:
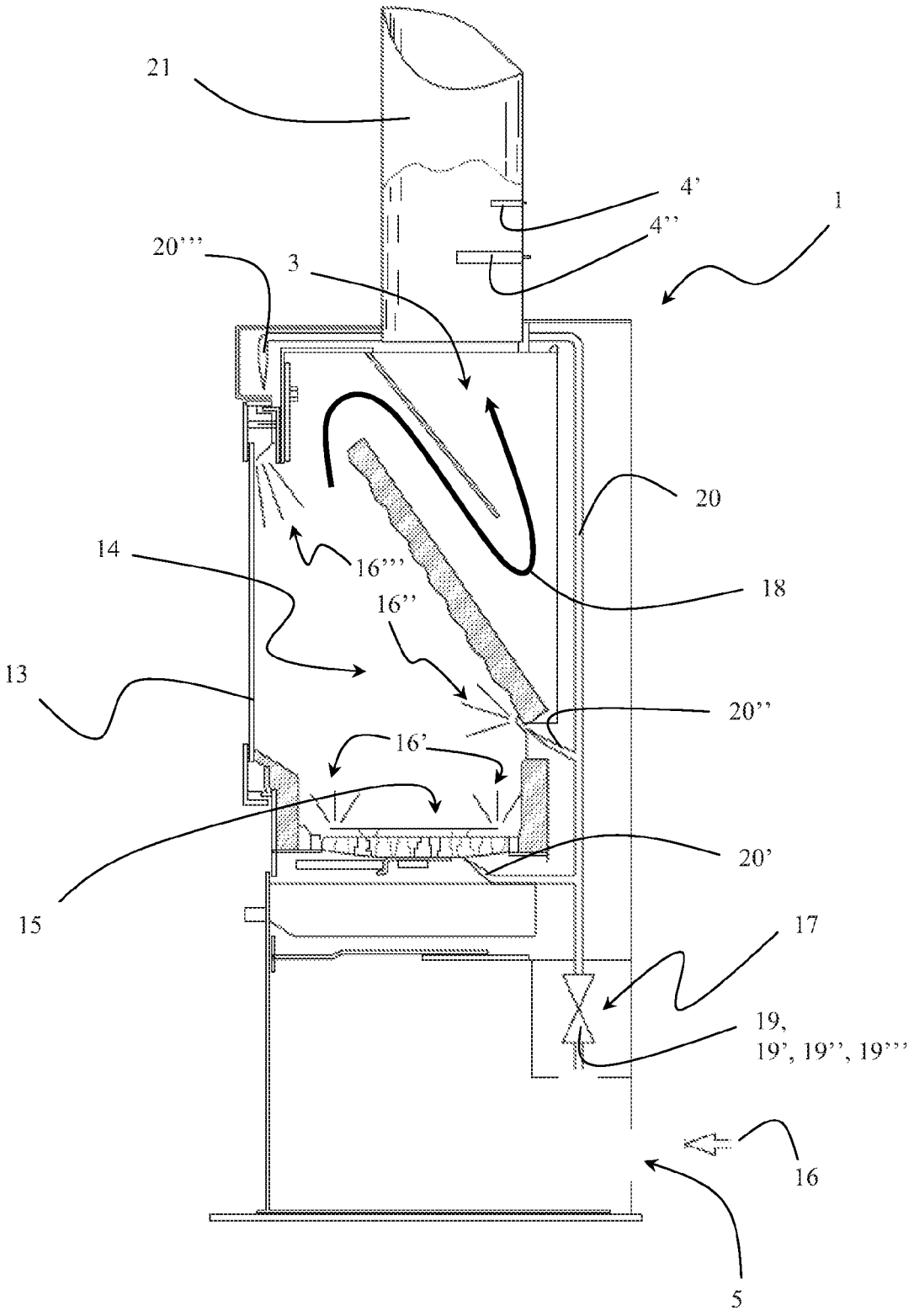
FIG. 2 shows a wood burning stove with a combustion chamber whereto combustion air is fed from a air regulator.

FIG. 2 shows a wood stove 1 with a combustion chamber 14 with a base 15 and whereto combustion air 16 is fed from a air regulator 17 and wherefrom a flue gas exhaust 18 guided away.

The wood stove 1 has the air regulator 17 positioned at the lower part of the wood stove below the base 15 of the combustion chamber 14.

The air regulator 17 has a number of valves 19 each connected via an air duct 20 to conduct combustion air 16 from the outside of the combustion chamber 14 to inside the combustion chamber 14.

In particular the air regulator 17 has a primary valve 19' that controls the flow of combustion air 16' through a primary air duct 20' from the intake 5 to the lower part of the combustion chamber 14. In this embodiment the primary air duct 20' is adapted to guide combustion air 16' through the base 15.

In particular the air regulator 17 has a secondary valve 19" that controls the flow of combustion air 16" through a secondary air duct 20" from the intake 5 to the middle part of the combustion chamber 14.

In this embodiment the secondary air duct 20" is adapted to guide combustion air 16" to the rear side of the combustion chamber 14, which rear sided is opposite the window or door 13.

In particular the air regulator 17 has a tertiary valve 19''' that controls the flow of combustion air 16''' through a tertiary air duct 20''' from the intake 5 to the upper part of the combustion chamber 14.

In this embodiment the tertiary air duct 20" is adapted to guide combustion air 16''' to the front side of the combustion chamber 14, which front side is the same side as the door or window 13.

The wood stove 1 has connection means for connecting the exhaust 3 or connection to a chimney 21. In this embodiment the exhaust measure means 4 are positioned inside the chimney 21. The exhaust measure means 4 includes a thermometer 4' and a λ-probe as the $O_2$-measurement means 4".

Figure 3:
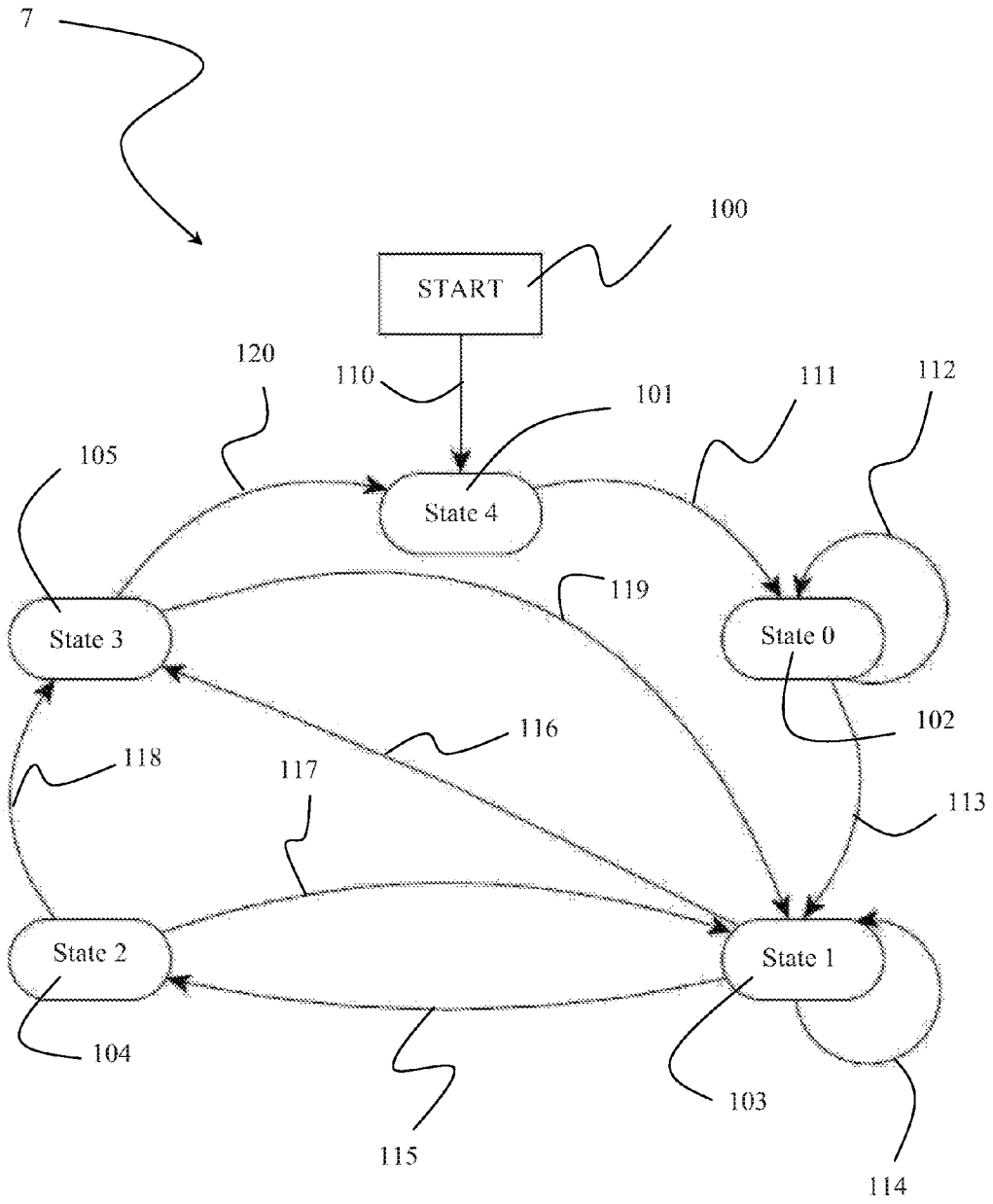
FIG. 3 shows an example of a state diagram for controlling the burning in a stove.

FIG. 3 shows an example of a state diagram for controlling the burn in a wood stove 1. The state diagram is embedded in the burn controller 2 as a software programme and in particular as burn control algorithm 7.

The state diagram or state controller has a set of start instructions 100 followed by five states during operation. The five states include a $4^{th}$ state 101, $0^{th}$ state 102, a $1^{st}$ state 103, a $2^{nd}$ state 104, and a $3^{rd}$ state 105.

The $0^{th}$ state is a cold start state 102 where the wood stove 1 is cold meaning.

The $1^{st}$ state is a warm start state 103 where the wood stove 1 has been operated and is still warm.

The $2^{nd}$ state is a combustion state 104 where the fuel burns in the wood stove 1.

This allows for the burn controller 2 to maintain the burn in the wood stove 1 as long as there is fuel and settings and measures require combustion.

The $3^{rd}$ state is a glow state 105 where the fuel glows in the wood stove 1.

The $4^{th}$ state is an off state 101 where the wood stove 1 is closed down and the fuel burn is terminated.

During each state 101, 102, 103, 104, 105 the burn controller 2 controls valves 19 in the air regulator 19.

The burn controller 2 is configured to receive input from exhaust measures 4 and in this case from a user interface 11 which measures and inputs are used to determine when the state controller shall make a shift or a transition from one state to the same, "a reset", or another state.

In the show embodiment of the state controller there are transitions or shifts from one state to another state as follows.

4-1 shift 111 is a shift or transition from the 4th state 101 to the 0th state 102 or from the start state to the OFF-state.

0-0 shift 112 is a shift or transition from the $0^{th}$ state 102 to the $0^{th}$ state 102 or from the cold start state to the cold start state. Such shift or transition from and to the same state is performed if the procedure in the state is not finished or need to be restarted.

0-1 shift 113 is a shift or transition from the $0^{th}$ state 102 to the $1^{st}$ state 103 or from the cold start state to the warm state.

1-1 shift 114 is a shift or transition from the 1st state 103 to the 1st state 103 or from the warm state to the warm state.

1-2 shift 115 is a shift or transition from the 1st state 103 to the 2nd state 104 or from the warm state to the combustion state.

1-3 shift 116 is a shift or transition from the 1st state 103 to the 3rd state 105 or from the warm state to the glow state.

2-1 shift 117 is a shift or transition from the 2nd state 104 to the 1st state 103 or from the combustion state to the warm state.

2-3 shift 118 is a shift or transition from the 2nd state 104 to the 3rd state 105 or from the combustion state to the glow state.

3-1 shift 119 is a shift or transition from the 3rd state 105 to the 1st state 103 or from the glow state to the warm state.

3-4 shift 120 is a shift or transition from the 3rd state 105 to the 4th state 101 or from the glow state to the off state.

As is apparent other possible shifts such as 0-0, 2-1, . . . etc. are not shown in this embodiment, but they are implementable in a similar way.

FIGS. 4 through 13 illustrate valve control schemes for each of the states $0^{th}$ 101, $1^{st}$ 102, $2^{nd}$ 103, $3^{rd}$ 104, and $4^{th}$ 105 states. Each state is controlled at least one valve control scheme depending on the previous state. The control schemes shown in FIGS. 4 to 8 relate to an embodiment of the invention, in which the primary, secondary and tertiary air ducts are controllable by means of respective valves 19, 19', 19", 19'", and FIGS. 8 to 13 relate to an embodiment of the invention, in which only the primary and secondary air ducts are controlled by means of respective valves, while the tertiary air duct is kept at a constant position.

Each scheme has an initial value, a PD controller input and a set point value for each of the primary, secondary, and, where applicable, tertiary valves.

Figure 4:
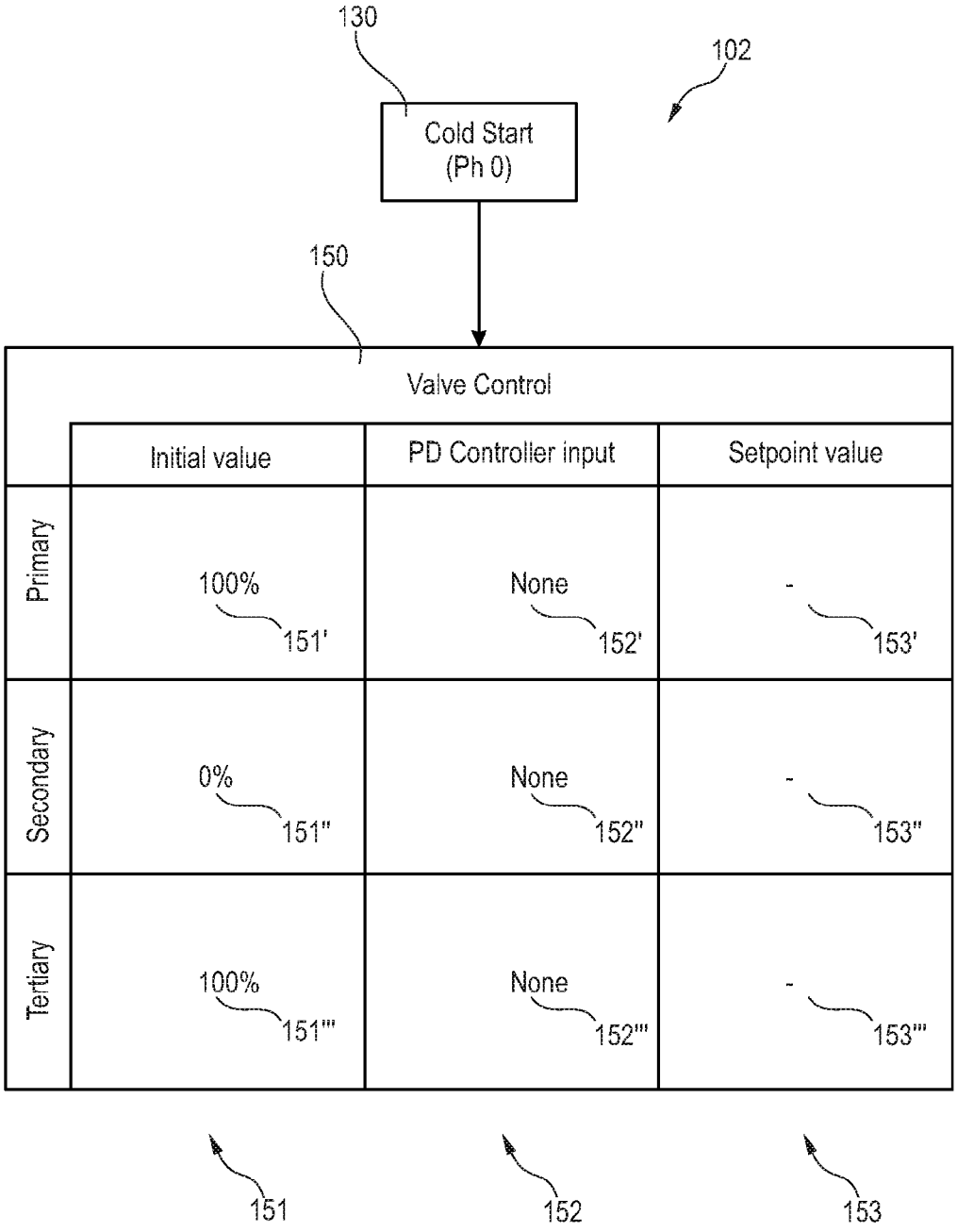
FIG. 4 shows an example of a cold start phase or phase 0 state of the controller in an embodiment of the invention, in which all three valves are controllable.
Figure 9:
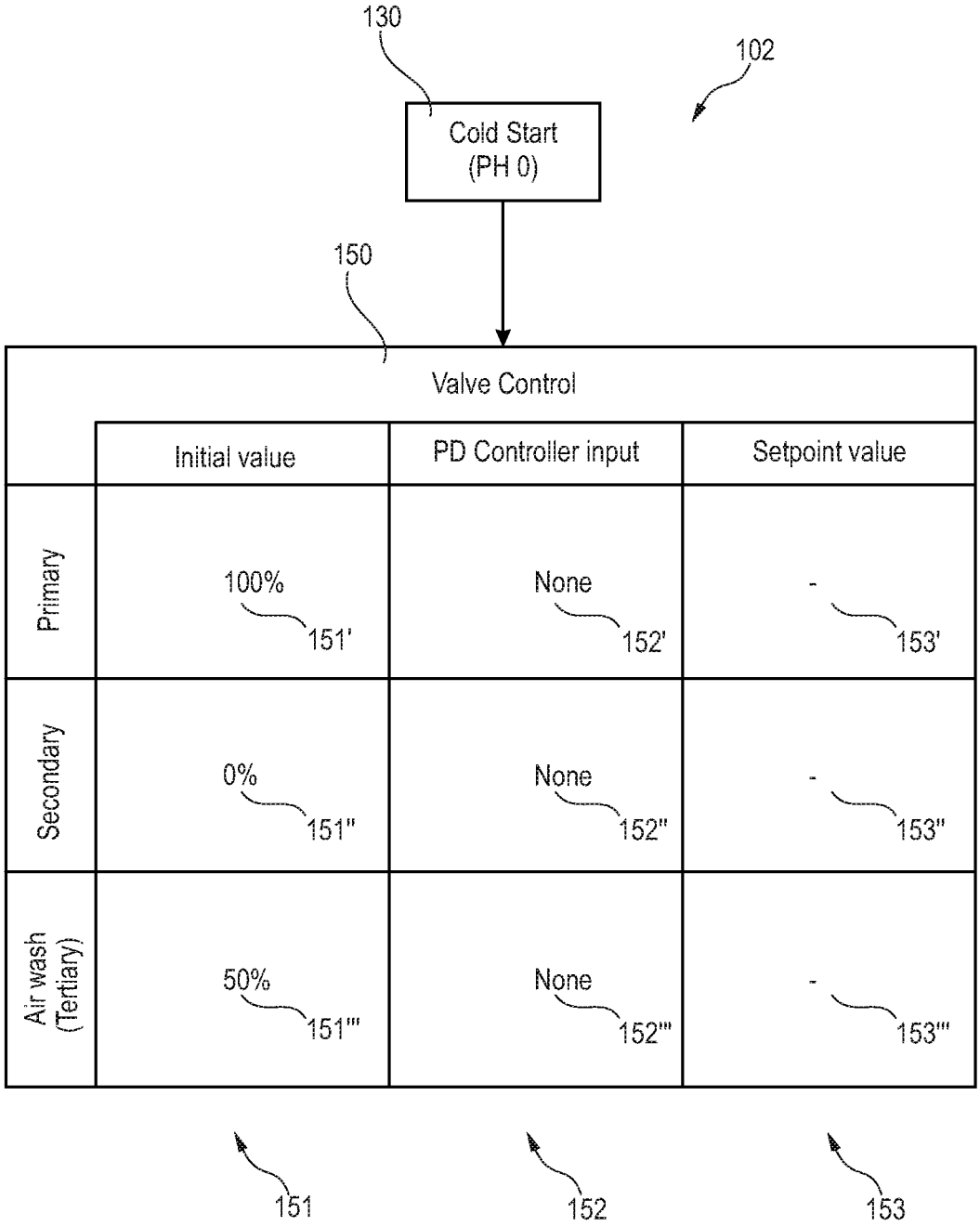
FIG. 9 shows an example of a cold start phase or phase 0 state of the controller in an embodiment of the invention, in which only valves are controlled, and in which the tertiary valve is maintained at a constant position.

FIGS. 4 and 9 show an example of a cold start phase 102, the $0^{th}$ state, with a cold start control 130 that includes a cold start valve control scheme 150. The cold start valve control scheme 150 has initial values 151, PD controller input values 152, and set point values 153 for each of the primary, secondary, and tertiary valves.

There is a primary initial value 151' which in this instance is 100% resulting in that the primary valve 19' is 100% opened for a maximum intake of primary combustion air 16' to the combustion chamber 14.

There is a secondary initial value 151" which in this instance is 0% resulting in that the secondary valve 19" is 0% opened, i.e. 100% closed, for a minimum or zero intake of secondary combustion air 16'" to the combustion chamber 14.

There is a tertiary initial value 151'" which in the instance of FIG. 4 is 100% resulting in that the tertiary valve 19'" is 100% opened for a maximum intake of tertiary combustion air 16" to the combustion chamber 14. In the instance of FIG. 9, the tertiary initial value is fixed at 50% opened.

There is a primary controller input 152' that is unregulated or floating. Likewise the secondary controller input 152" and the tertiary controller input 152'" are unregulated or floating.

There is a primary set point value 153' that is empty or null. Likewise the secondary set point value 153" and the tertiary set point values are empty or null.

Figure 5:
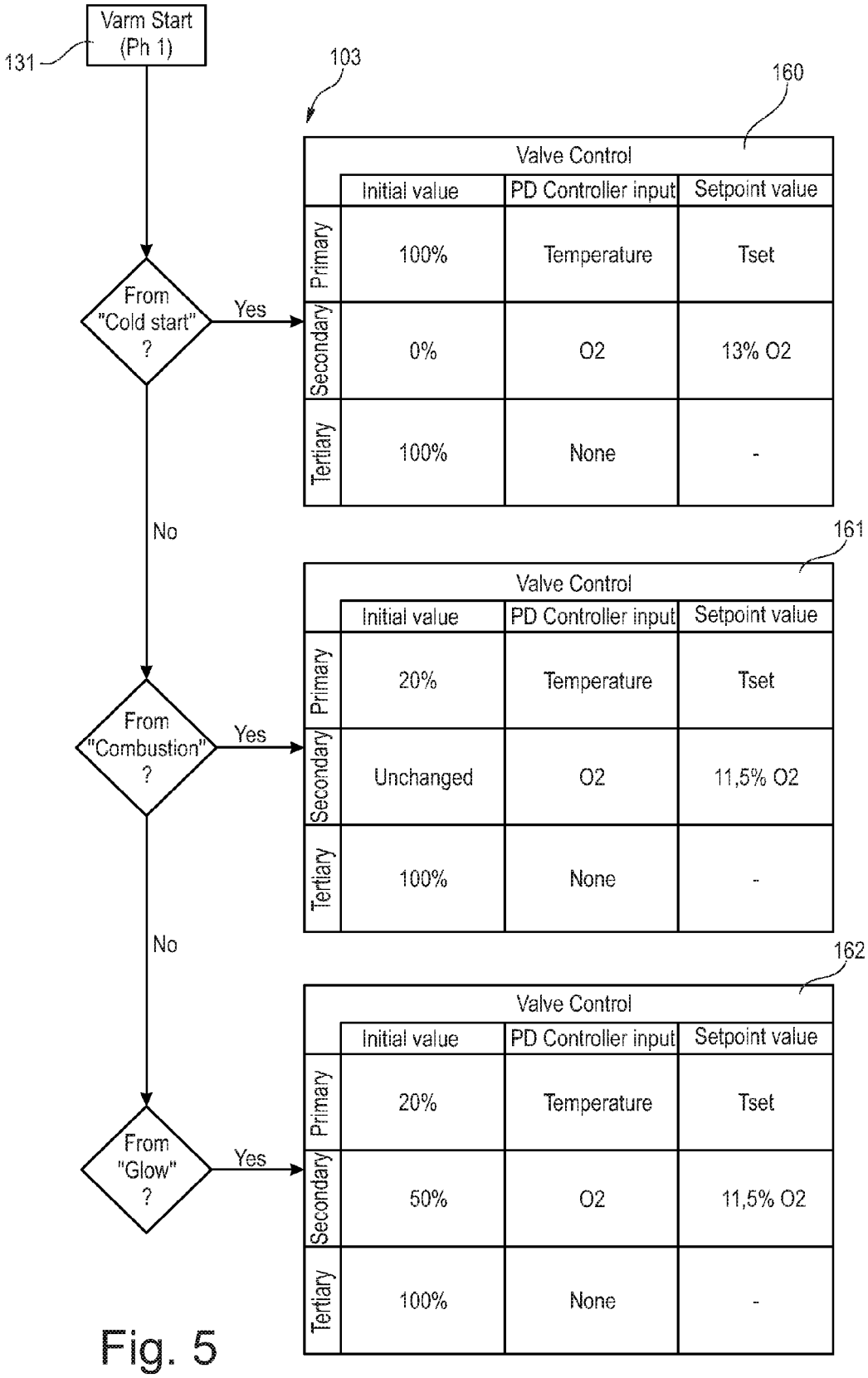
FIG. 5 shows an example of a warm start phase or phase 1 of the controller in an embodiment of the invention, in which all three valves are controllable.
Figure 10:
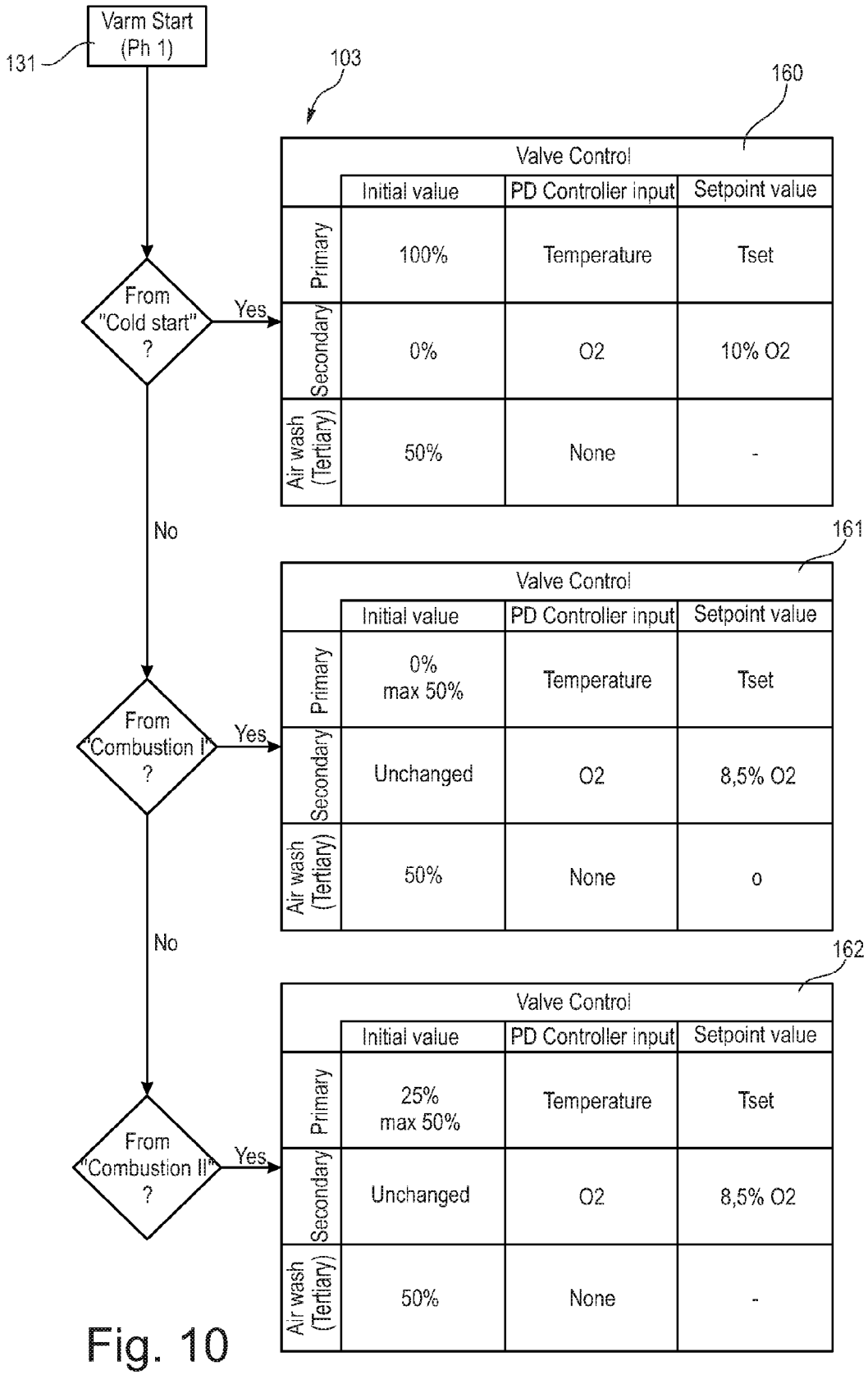
FIG. 10 shows an example of a warm start phase or phase 1 of the controller in an embodiment of the invention, in which only valves are controlled, and in which the tertiary valve is maintained at a constant position.

FIGS. 5 and 10 show an example of a warm start phase 103, the $1^{st}$ state or phase, with a warm start control 131 that includes a cold to warm start valve control scheme 160, a combustion to warm valve control scheme 161, and a glow to warm valve control scheme 162.

Following the numeration from FIG. 4, the cold to warm start valve control scheme 160 has:

A primary initial value of 100% resulting in that the primary valve 19' is fully opened for delivering a maximum of primary combustion air 16' to the combustion chamber 14.

There is a primary controller input that regulates the temperature. The regulator is based on a primary set point value Tset according to for example a user input via the user interface or a preset standard desirable temperature.

There is a secondary initial value of 0% resulting in that the secondary valve 19" is fully closed for initially delivering no secondary combustion air 16" to the combustion chamber.

There is a secondary controller input that regulates the oxygen, $O_2$, level in the exhaust 3 towards a secondary set point value of 13% $O_2$.

In FIG. 5, a tertiary initial value of 100% results in that the tertiary valve 19'" is fully opened for delivering a maximum of tertiary combustion air 16'" to the combustion chamber 14. In FIG. 10, the tertiary initial value is fixed at 50% opened.

In the embodiment of FIGS. 4-8, there is provided a tertiary controller input that is left unregulated or floating and with a null nor irrelevant set point value.

The combustion to warm start valve control scheme 161 has:

A primary initial value of 20% (FIG. 5) resulting in that the primary valve 19' is 20% open for delivering some primary combustion air 16' to the combustion chamber 14. In FIG. 10, the primary initial value is between 0% (i.e. closed) and 50%.

There is a primary controller input that regulates the temperature in the exhaust 3 towards a primary set point value that is determined by Tset.

There is a secondary initial value that is unchanged (FIGS. 5 and 10 alike).

There is a secondary controller input that, in the embodiment of FIG. 5, regulates the Oxygen level towards a tertiary set point value of 11.5% $O_2$. (8.5% $O_2$ in FIG. 10).

There is a tertiary initial value of 100% resulting in that the tertiary valve 19'" is fully open for delivering a maximum of secondary combustion air 16'" to the combustion chamber 14.

There is a tertiary controller input that is left unregulated or floating and with a null nor irrelevant set point value resulting in that the tertiary valve 19'" is left at the initial value (FIG. 5). At 161, the tertiary initial value is fixed at 50% in FIG. 10.

The glow to warm start valve control scheme 162 has:

A primary initial value of 20% resulting in that the primary valve 19' is 20% open for delivering some primary combustion air 16' to the combustion chamber 14. In FIG. 10, the primary initial value is between 25 and 50%.

There is a primary controller input that regulates the temperature in the exhaust 3 towards a primary set point value that is determined by Tset.

In FIG. 5, there is a secondary initial value of 50% resulting in that the secondary valve 19" is half open for delivering half maximum of tertiary combustion air 16" to the combustion chamber. In FIG. 10, the secondary initial value is unchanged at 162.

There is a secondary controller input that regulates the Oxygen level towards a secondary set point value of 11.5% $O_2$. In FIG. 10, the secondary oxygen set point value is 8.5% $O_2$.

There is a tertiary initial value of 100% (FIG. 5) resulting in that the tertiary valve 19' is fully open for delivering a maximum of secondary combustion air 16' to the combustion chamber 14. In FIG. 5, the tertiary initial value remains fixed at 50%.

In FIG. 5, there is a tertiary controller input that is left unregulated or floating and with a null nor irrelevant set point value resulting in that the tertiary valve 19' is left at the initial value.

The warm start control 131 is further configured for determining the previous state thereby enabling the desired selection of the valve control scheme 160, 161, 162.

Figure 6:
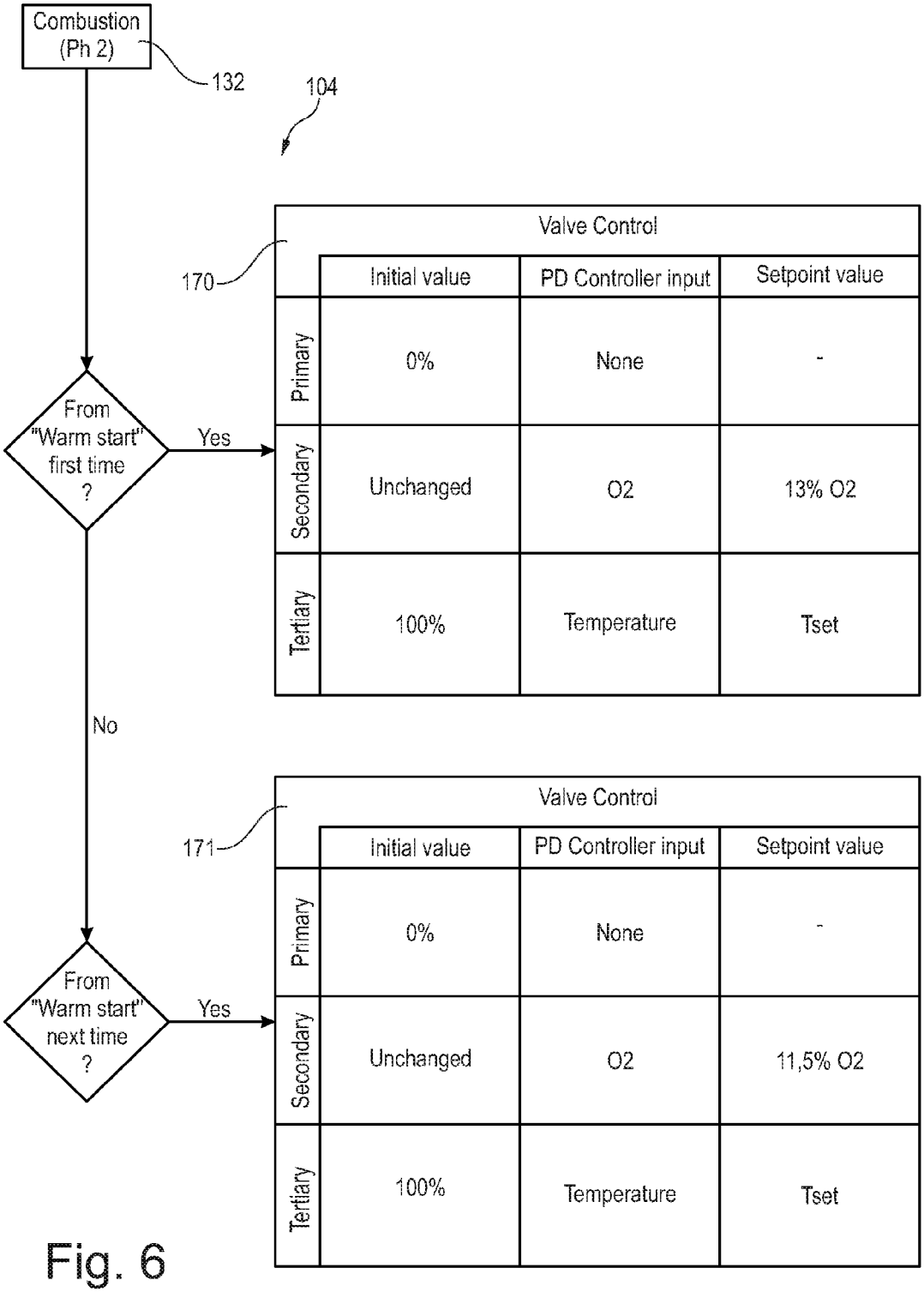
FIG. 6 shows an example of a combustion phase or phase 2 of the controller in an embodiment of the invention, in which all three valves are controllable.
Figure 11:
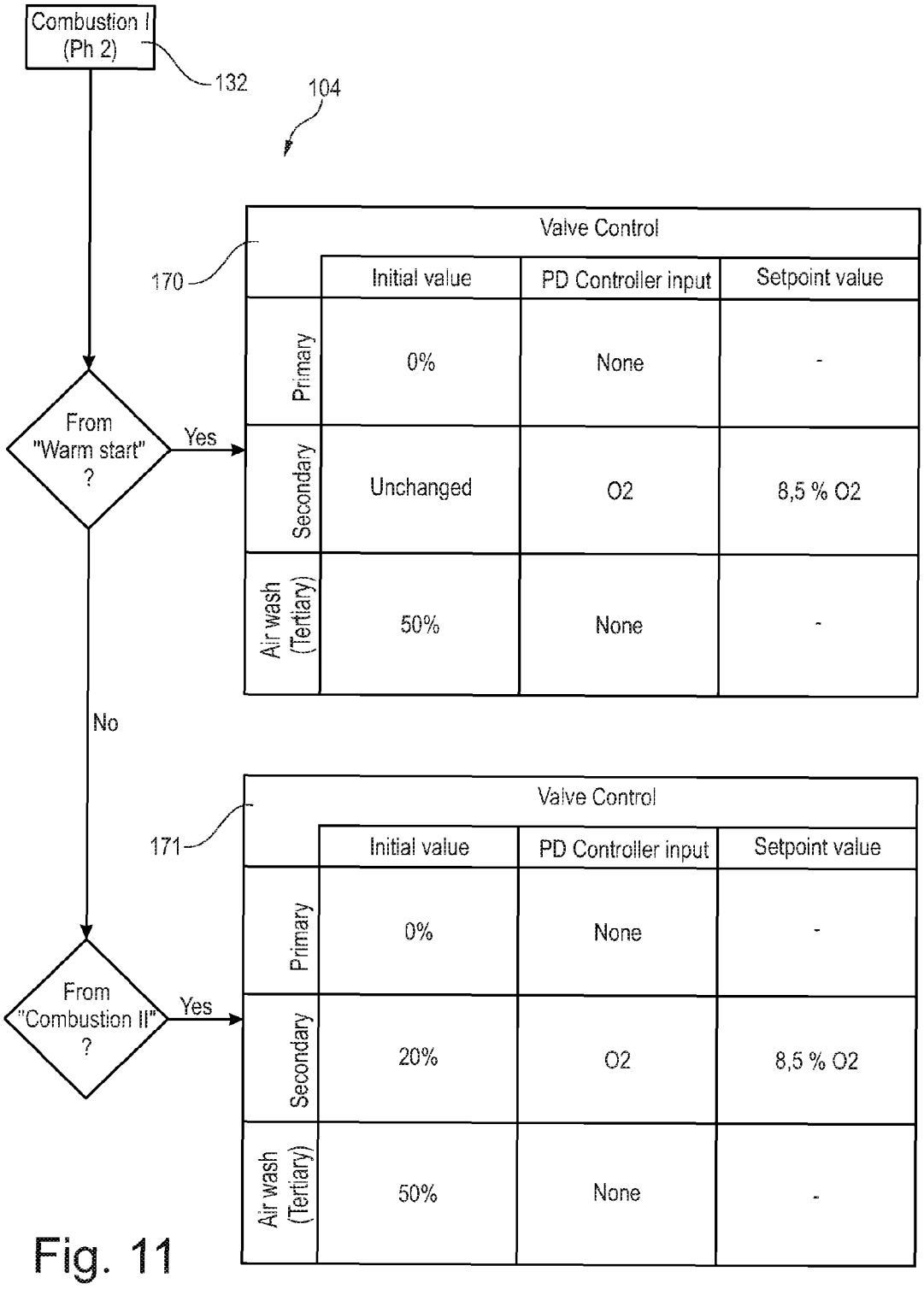
FIG. 11 shows an example of a first combustion phase or phase 2 of the controller in an embodiment of the invention, in which only valves are controlled, and in which the tertiary valve is maintained at a constant position.

FIGS. 6 and 11 show examples of a combustion state 104, the $2^{nd}$ state, and a combustion control 132 controlling a first warm to combustion valve control scheme 170 and a subsequent warm to combustion valve control scheme 171. The combustion state of FIG. 11 is a first combustion state, whereas a second combustion state is described below with reference to FIG. 11*a*.

The first warm to combustion valve control scheme 170 has:

A primary initial value of 0% resulting in that the primary valve 19' is fully closed for delivering zero primary combustion air 16' to the combustion chamber 14.

There is a primary controller is left unregulated and the primary set point value is null.

There is a secondary initial value that is left unchanged.

There is a secondary controller input that regulates the oxygen, $O_2$, level in the exhaust 3 towards a tertiary set point value of 13% $O_2$ (FIG. 6) and 8.5% $O_2$ (FIG. 11), respectively.

In the embodiment of FIG. 6, a tertiary initial value of 100% results in that the tertiary valve 19' is fully opened for delivering a maximum of tertiary combustion air 16' to the combustion chamber 14. In FIG. 11, the tertiary initial value remains fixed at 50%.

In the embodiment of FIG. 6, there is provided a tertiary controller input that regulates temperature towards a temperature determined by a tertiary set point value Tset, whereas no controller input is provided in the embodiment of FIG. 11.

The subsequent warm to combustion valve control scheme 171 has:

A primary initial value of 0% resulting in that the primary valve 19' is fully closed for delivering zero primary combustion air 16' to the combustion chamber 14 (FIGS. 6 and 11 alike).

There is a primary controller is left unregulated and the primary set point value is null.

There is a secondary initial value that is left unchanged in the embodiment of FIG. 6, whereas the secondary initial value at 171 is set to 20% open for the secondary valve 19" in the embodiment of FIG. 11.

There is a secondary controller input that regulates the oxygen, $O_2$, level in the exhaust 3 towards a secondary set point value of 11.5% $O_2$ (FIG. 6) and 8.5% $O_2$ (FIG. 11), respectively.

In FIG. 6, a tertiary initial value of 100% results in that the tertiary valve 19'" is fully opened for delivering a maximum of secondary combustion air 16'" to the combustion chamber 14. In FIG. 11, the tertiary initial value remains fixed at 50%.

In the embodiment of FIG. 6, a tertiary controller input is provided for regulating temperature towards a temperature determined by a tertiary set point value Tset.

Figure 7:
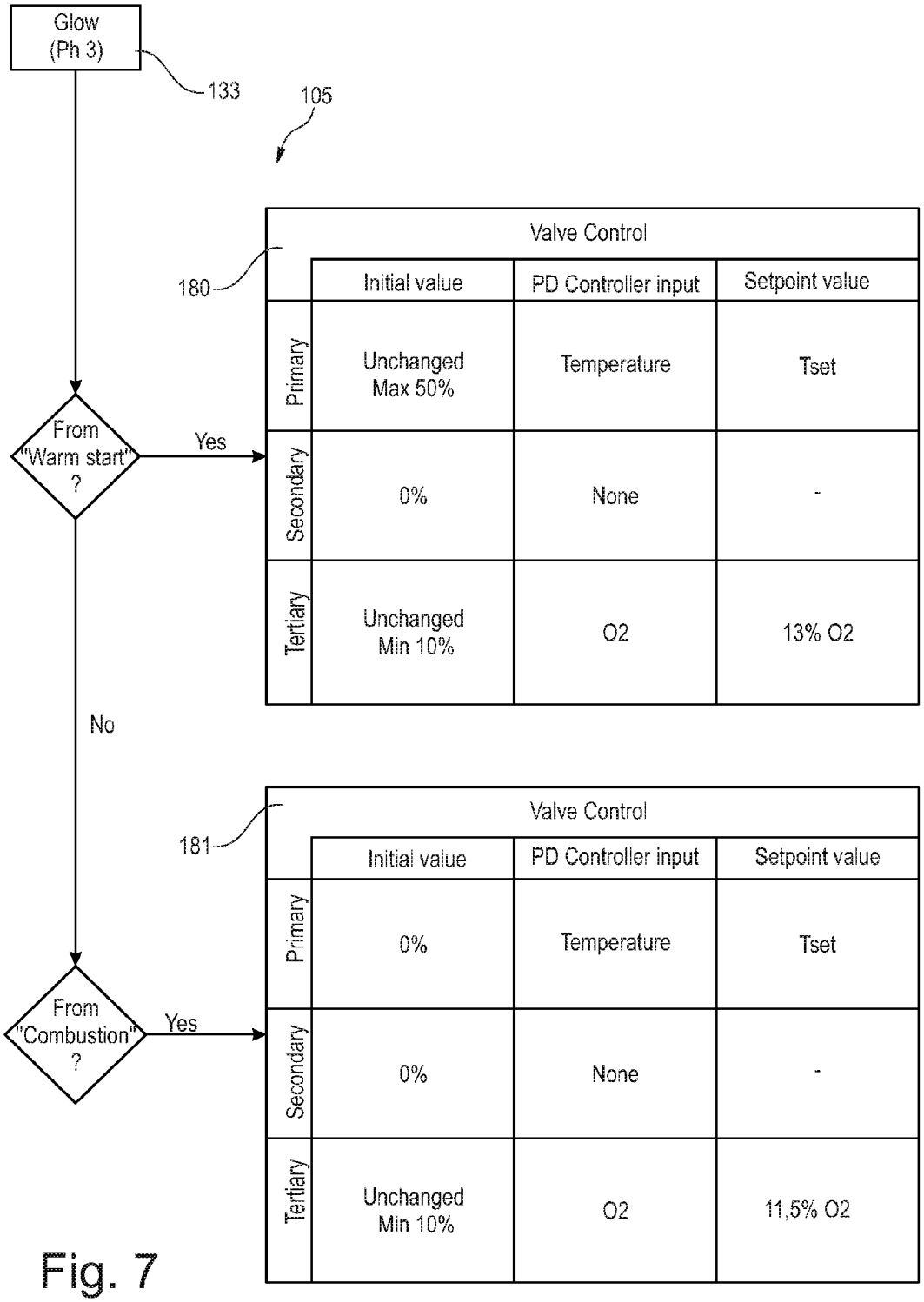
FIG. 7 shows an example of a glow phase or phase 3 of the controller in an embodiment of the invention, in which all three valves are controllable.
Figure 12:
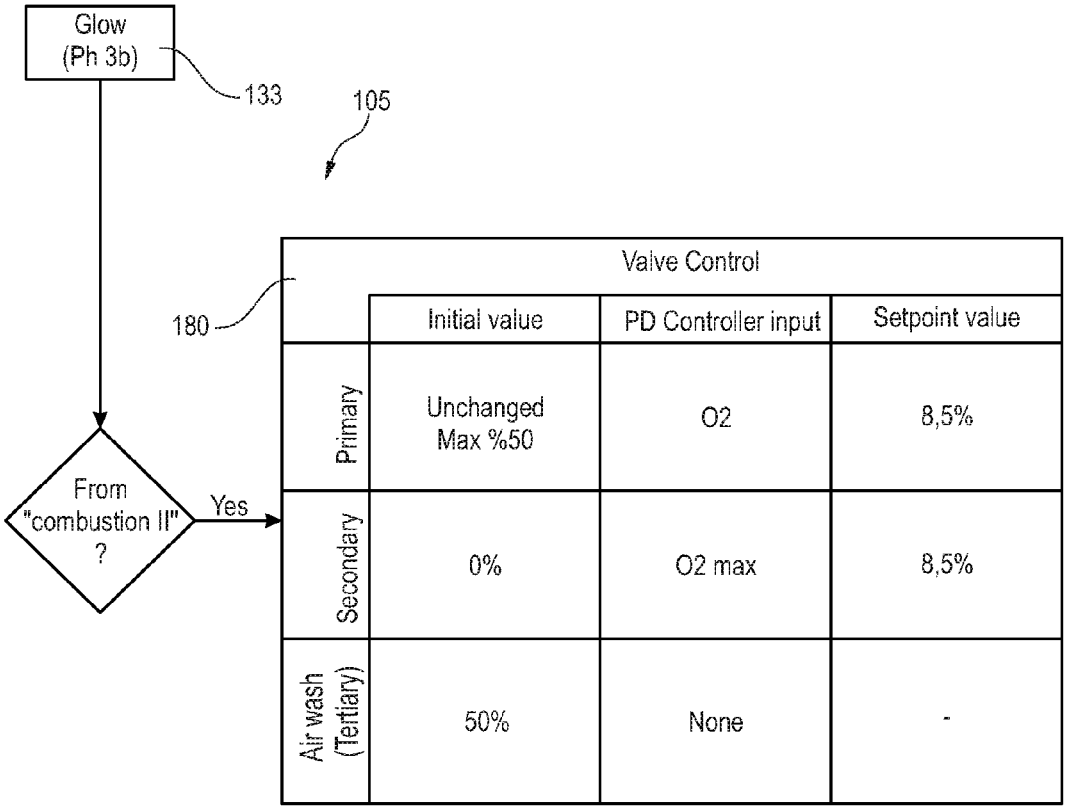
FIG. 12 shows an example of a glow phase or phase 3 of the controller in an embodiment of the invention, in which only valves are controlled, and in which the tertiary valve is maintained at a constant position.

FIGS. 7 and 12 show examples of a glow state 105, the $3^{rd}$ state, and a glow state control 133 that controls a warm start to glow valve control scheme 180 and a combustion to glow valve control scheme 181.

Figure 11A:
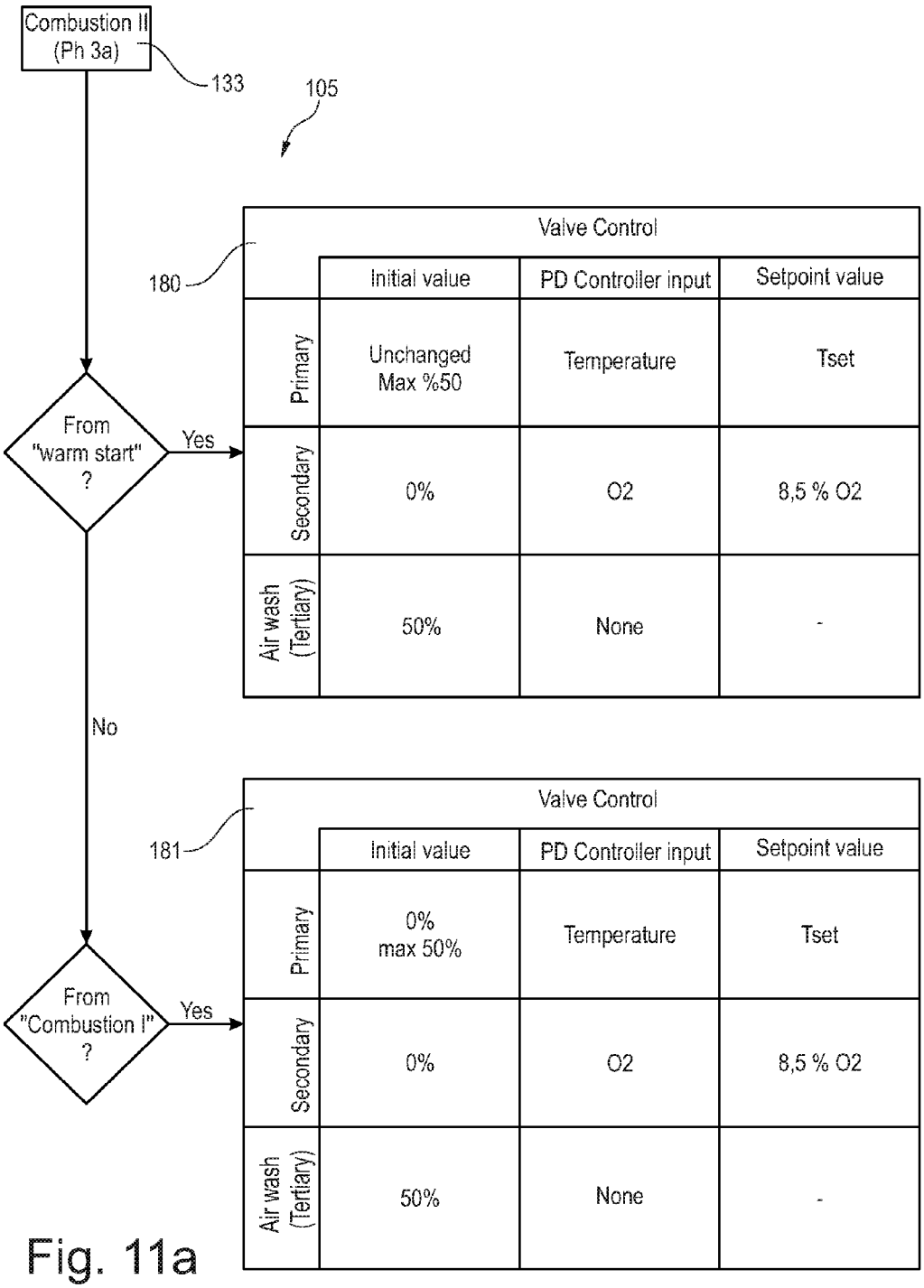
FIG. 11*a* shows an example of a second combustion phase or phase 2 of the controller in an embodiment of the invention, in which only valves are controlled, and in which the tertiary valve is maintained at a constant position.

Before describing the glow state 105 of FIGS. 7 and 12, reference is initially made to FIG. 11*a*, which shows second combustion phase, i.e. phase 3*a*.

The warm start to glow valve control scheme 180 of FIG. 11*a* includes the following:

A primary initial value that is left unchanged and with a maximum of 50% resulting in that the primary valve 19' is at maximum half opened for delivering half primary combustion air 16' to the combustion chamber 14 as a maximum.

There is a primary controller regulates temperature towards a primary set point value determined by Tset.

There is a secondary initial value of 0%, i.e. closing the secondary valve 19".

There is a secondary controller input that regulates oxygen level towards an oxygen level at 8.5% $O_2$.

The combustion I state to glow valve control scheme 181 of FIG. 11*a* includes the following:

A primary initial value that is 0% resulting in that the primary valve 19' is closed for delivering no primary combustion air 16' to the combustion chamber 14.

There is a primary controller regulates temperature towards a primary set point value determined by Tset.

There is a secondary initial value at 0%, i.e. closing the secondary valve 19".

There is a secondary controller input that regulates oxygen level towards an oxygen level at 8.5% $O_2$.

In FIGS. 7 and 12, the warm start to glow valve control scheme 180 includes the following:

A primary initial value that is left unchanged and with a maximum of 50% resulting in that the primary valve 19' is at maximum half opened for delivering half primary combustion air 16' to the combustion chamber 14 as a maximum.

There is a primary controller regulates temperature towards a primary set point value determined by Tset (FIG. 7) and that regulates oxygen towards an $O_2$ level of 8.5% (FIG. 12).

There is a secondary initial value of 0% resulting in that the secondary valve 19'" is closed.

There is a secondary controller input that is left unregulated with no set point value (FIG. 7). In FIG. 12, the secondary controller input regulates $O_2$ to a maximum level of about 8.5%.

In FIG. 7, there is provided a tertiary initial value of that is left unchanged with a minimum of 10% resulting in that the tertiary valve 19'" is opened for delivering small amounts of tertiary combustion air 16'" to the combustion chamber 14. In FIG. 12, the tertiary value remains fixed at 50%.

There is a tertiary controller input that regulates oxygen level towards an oxygen level at 13% $O_2$.

The combustion state to glow valve control scheme 181 (FIG. 7 embodiment only) includes the following:

A primary initial value that is 0% resulting in that the primary valve 19' is closed for delivering no primary combustion air 16' to the combustion chamber 14.

There is a primary controller regulates temperature towards a primary set point value determined by Tset.

There is a secondary initial value of 0% resulting in that the secondary valve 19'" is closed.

There is a secondary controller input that is left unregulated with no set point value.

There is a tertiary initial value of that is left unchanged with a minimum of 10% resulting in that the tertiary valve 19'" is slightly opened for delivering small amounts of tertiary combustion air 16" to the combustion chamber 14.

There is a tertiary controller input that regulates oxygen level towards an oxygen level at 11.5% $O_2$.

Figure 8:
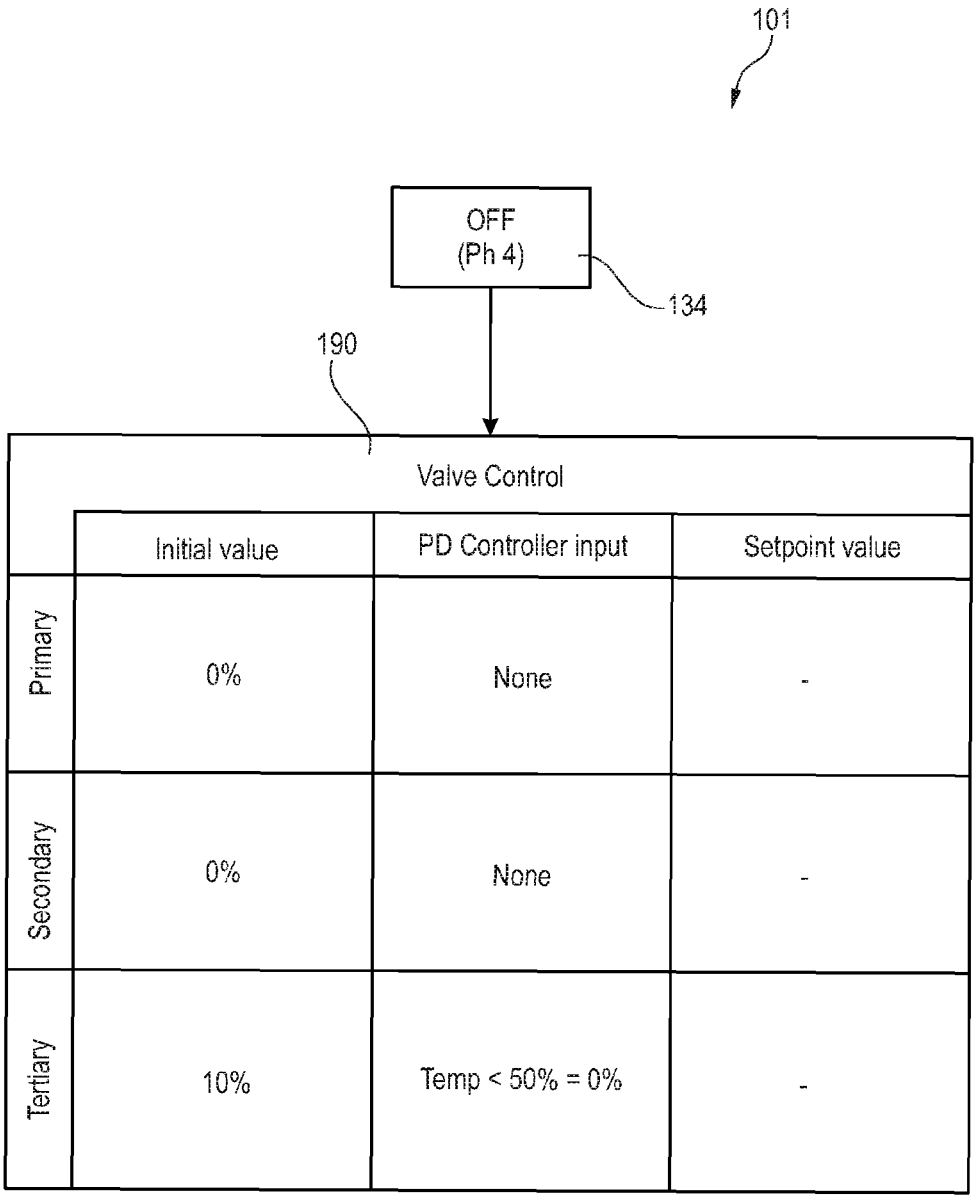
FIG. 8 shows and example of an OFF-phase or phase 4 of the controller in an embodiment of the invention, in which all three valves are controllable.
Figure 13:
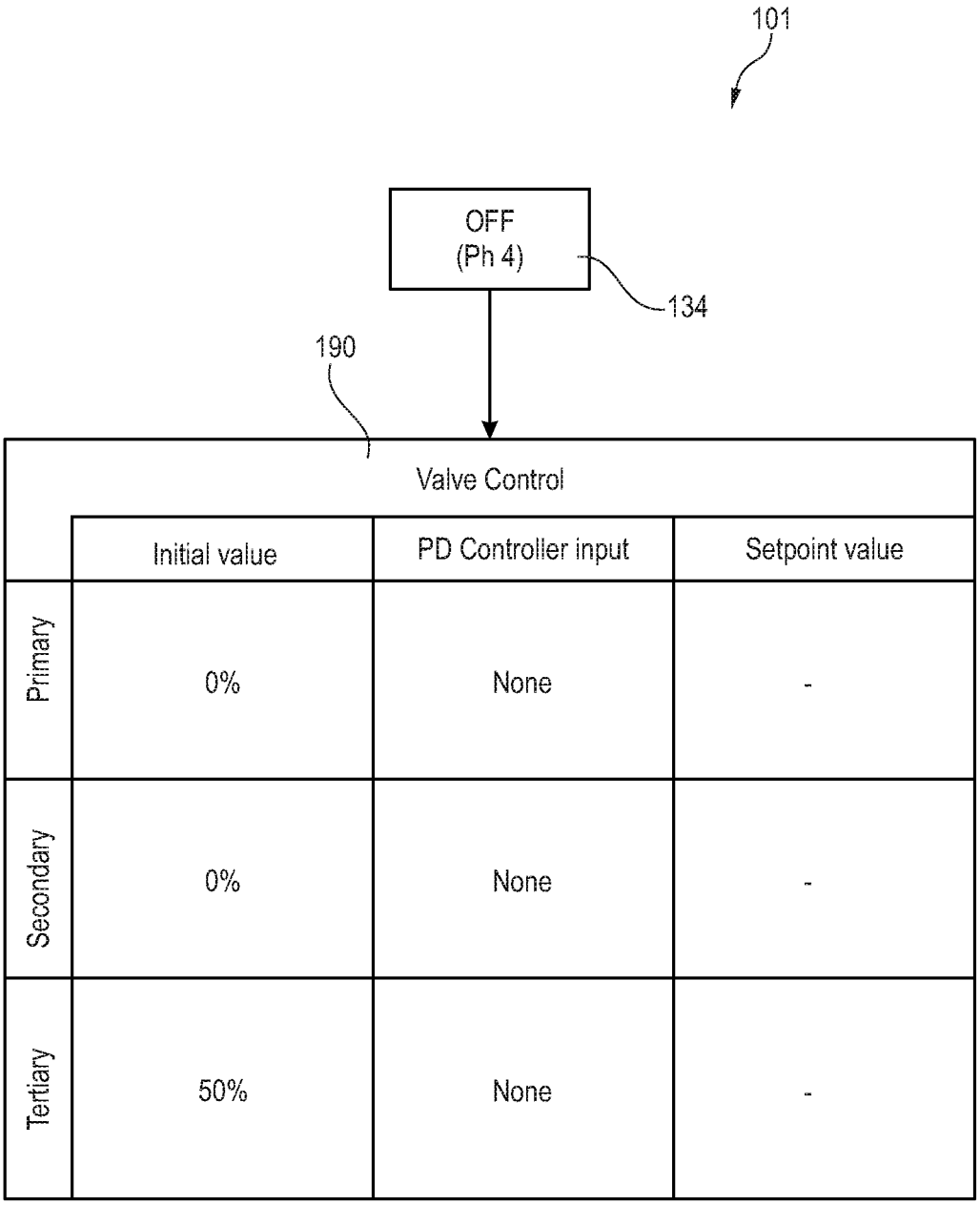
FIG. 13 shows and example of an OFF-phase or phase 4 of the controller in an embodiment of the invention, in which only valves are controlled, and in which the tertiary valve is maintained at a constant position.
Figure 14:
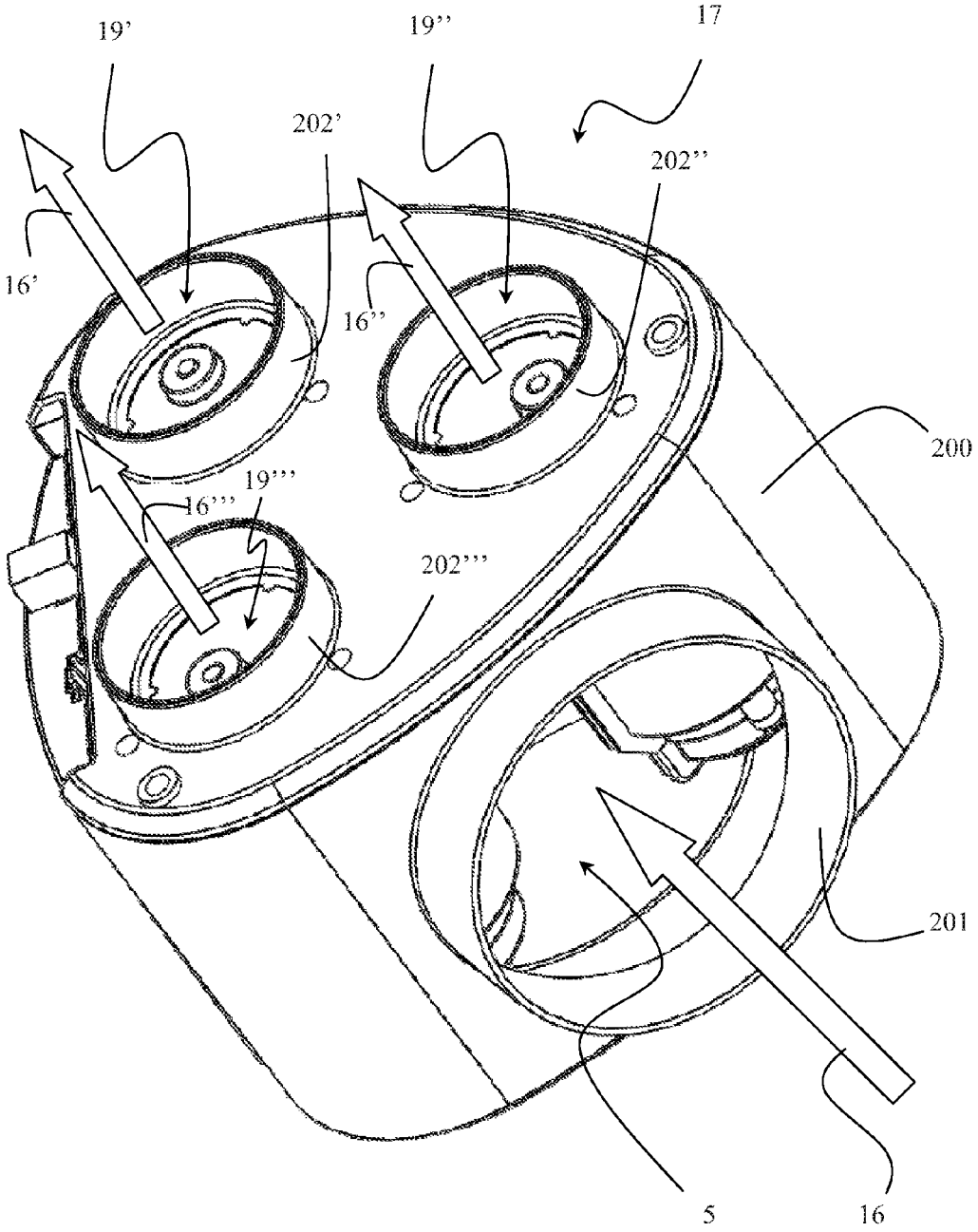
FIG. 14 shows an embodiment of an air regulating box with three valves: a primary, a secondary, and a tertiary valve.
Figure 15:
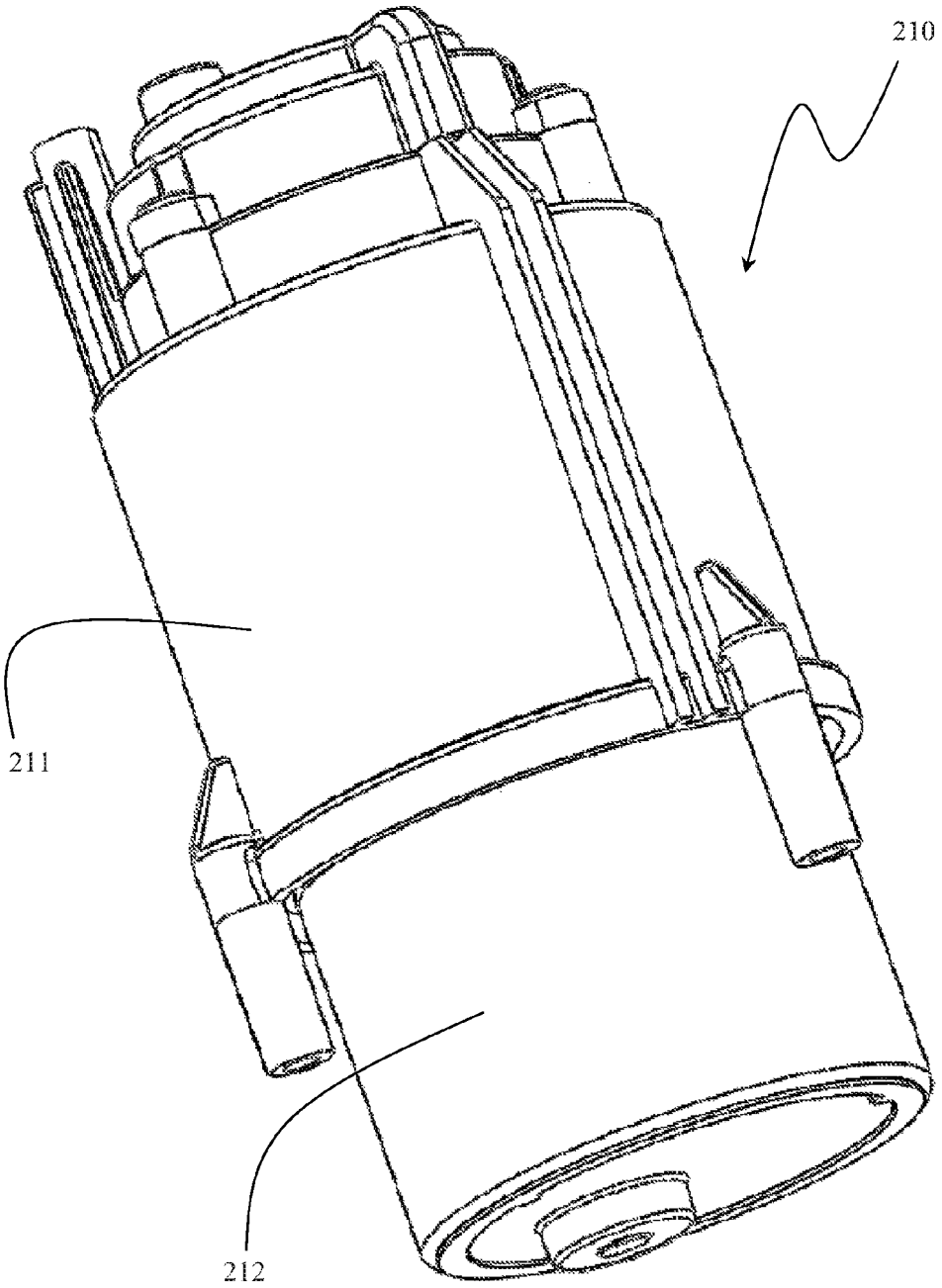
FIG. 15 shows and embodiment of a valve, a cylinder valve
Figure 16:
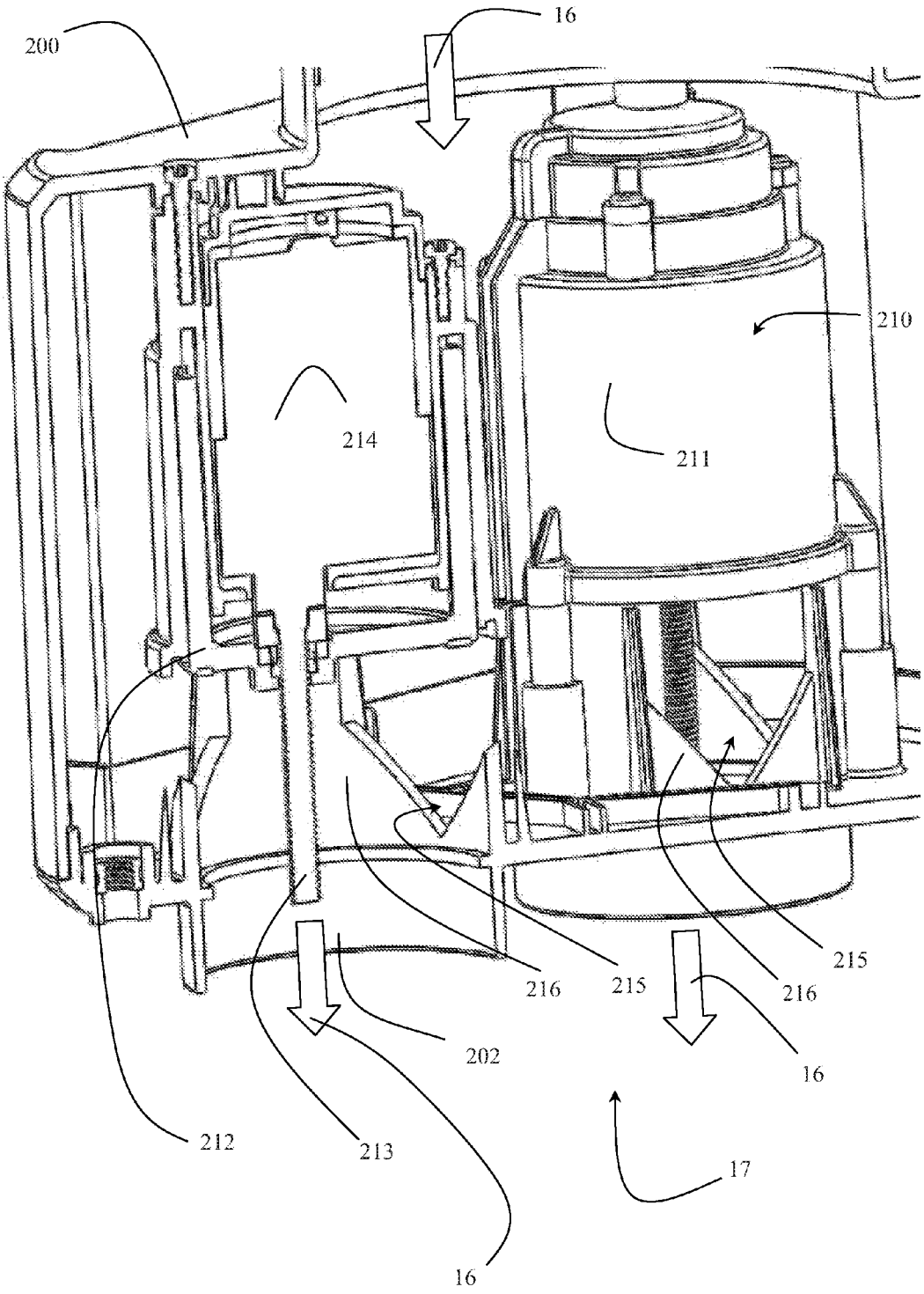
FIG. 16 shows sectional view of an air box with and two cylinder valves, one of which is seen in a cross sectional view.
Figure 17:
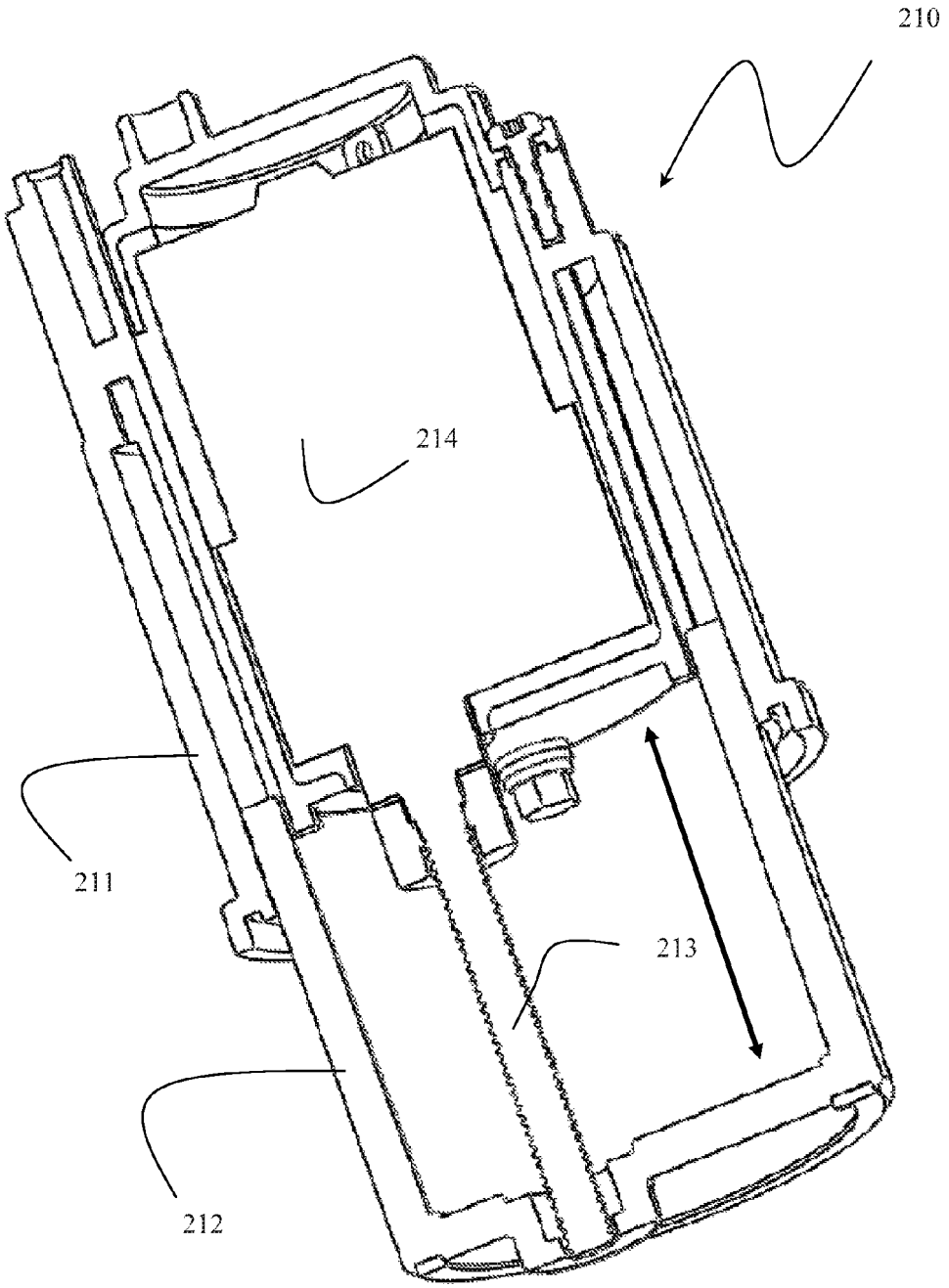
FIG. 17 shows a cross sectional view of a cylinder valve.
Figure 18:
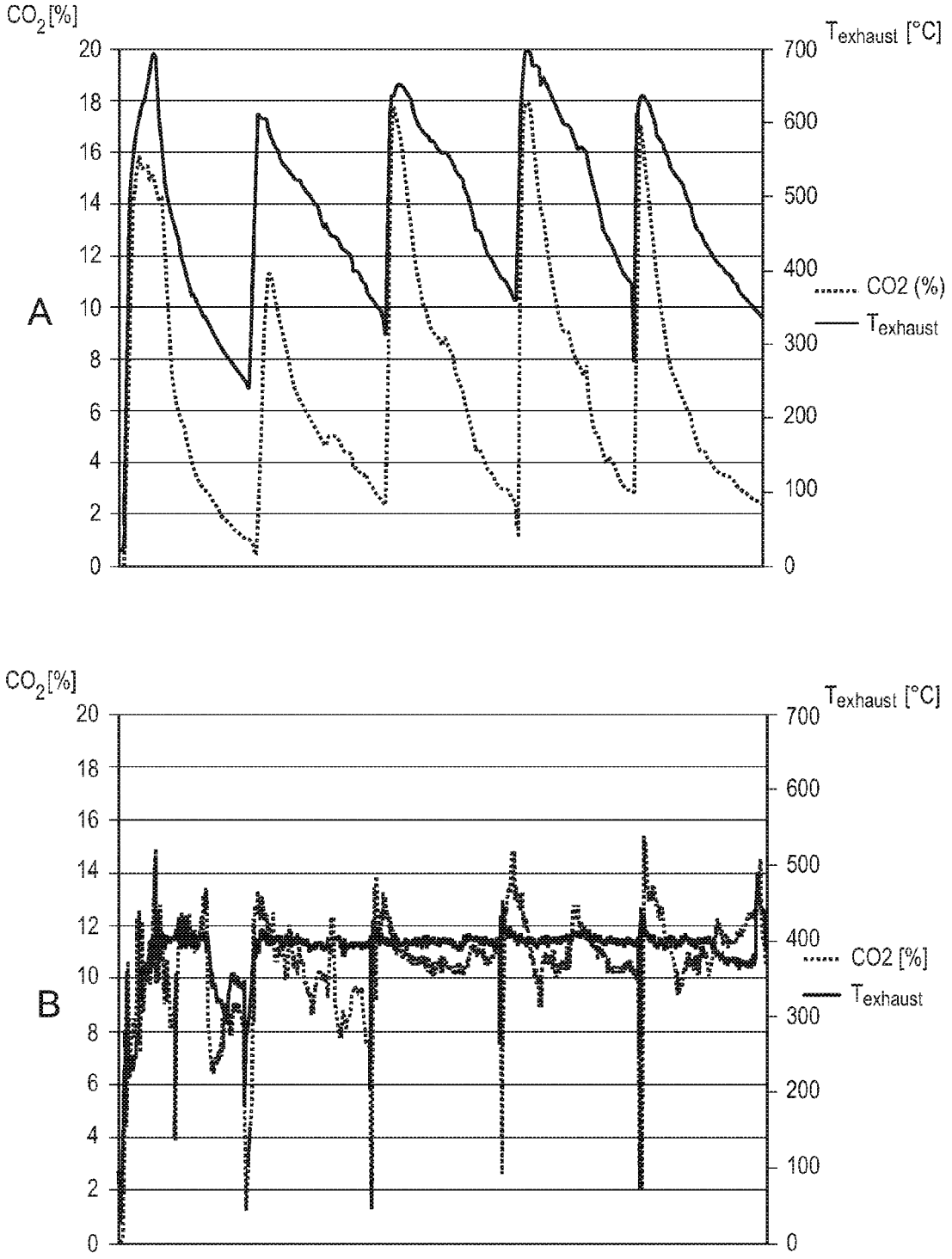
FIG. 18 shows the temperature of exhaust and the CO2 in the exhaust for a wood stove without the burn controller and air regulator and for a wood stove with the burn controller.

FIGS. 8 and 13 show examples of an OFF-state 105, the $4^{th}$ state, and a OFF state control 134 that controls a combustion to glow valve control scheme 190.

There is primary initial value of 0% resulting in that the primary valve 19' is closed for zero delivery of primary combustion air 16' to the combustion chamber 14.

There is a primary controller input that is left unregulated with a null set point value.

There is a secondary initial value of 0% resulting in that the secondary valve 19" is closed for zero delivery of tertiary combustion air 16" to the combustion chamber 14. There is a tertiary control input that is left unregulated with a null set point value.

In FIG. 8, there is a tertiary initial value of 10% resulting in that the tertiary valve 19'" is a slightly open for a delivery of small amounts of tertiary combustion air 16'" to the combustion chamber 14. In the embodiment of FIG. 13, the tertiary initial value remains fixed at 50%. However, in order to avoid heat from the surrounding room to dissipate into the cooled-down stove through the tertiary air duct, it may be closed to 0% in the off state.

In the embodiment of FIG. 8, there is a tertiary controller input regulating temperature if the temperature is below 50 degrees Celsius. Thereby remaining fuel is slowly extinguished. The tertiary set point value is null.

FIG. 9 shows an embodiment of an air regulator 17 with three valves 19: a primary valve 19', a secondary valve 19", and a tertiary valve 19'". The air regulating box 17 has a housing 200 with a intake connection means 201 and is formed to fit into a wood stove 1 so that the intake connection means 201 gets combustion air 16 from the intake 5.

The air regulator 17 has air duct connection means 202 for each valve 19.

There is a primary air duct connection means 202' for connecting the air box 17 to a primary air duct 20' allowing combustion air 16 from the intake 5 to be fed the combustion chamber 14 as primary combustion air 16' controlled by the primary valve 19'.

Likewise for the separate secondary and tertiary channels.

FIG. 10 shows and embodiment of a valve 19 which is a cylinder valve 210 with a valve housing 211 and a valve piston 212. The valve piston 212 is in extended to a position furthest out of the valve housing 211.

FIG. 11 shows sectional view of an air box 17 with and two cylinder valves 210, one of which is seen in a cross sectional view. In both cases the valve piston 212 is withdrawn into the valve housing 211.

The movement of the valve piston 212 is done via an actuator connector 213 connected to a actuator means 214. In this case the actuator connector 213 and actuator means combination is a shredded linear line that is rotated by a motor thereby linearly moving and positioning the valve piston 212 within the housing 200 to form a valve port 215 due to interaction or relative positioning against a valve port frame 216.

FIG. 12 shows a cross sectional view of a cylinder valve 210 with the valve housing 211, the valve piston 212 linearly movable in and out of the valve housing 211. The movement of the valve piston 212 is done along the actuator connector 213, which in this case is a screw that can be rotated by a motor as the actuator means 214.

The actuator means 214 is controlled by the valve control 6 and the arrangement with the calibrated, in particular the relative positioning of the valve port frame 216, the valve housing 211 and the valve piston 212 so that a signal of 100% open to the valve control 6 results in a withdrawal of the valve piston 212 into the valve housing 211 thereby making a maximum valve port 215 opening.

Likewise a signal of 0% open (close) to the valve control 6 results in a valve piston 212 out of the valve housing 211 and closing towards the valve port frame 216.

In this embodiment it is seen that the valve port frame 216 has a V-shaped opening so that the size of the valve port 15 opening can be controlled more precisely allowing for a finer control of smaller vale port 15 openings.

FIG. 13 shows the temperature of exhaust and the $CO_2$%-level in the exhaust for a wood stove without the burn controller and air regulator, A, and for a wood stove with the burn controller, B.

Each diagram shows the timely development of the temperature of the exhaust Texhaust on a scale from 0-700° C. and the percentage $CO_2$ level in the exhaust on a scale from 0-20%.

The test has carried out as a standard test according to EN13240 to be able to compare the a burn of a fuel in a standard wood stove with an embodiment of wood stove as disclosed in the case where standard wood stove is fitted with a air regulator, a burn controller and exhaust measures (albeit the O2 sensor being replaced with an equivalent CO2 sensor).

According to the standard test, there are three conditions or test circumstances: The best user is a laborant, best compromise for the chimney and installation, and best possible fuel load (in moist and weight distribution).

Each spike in the figures represents a refueling of the wood stove. It is clearly observed that the controlled or regulated burn is more constant. Although there are spikes present, these are narrow. The $T_{exhaust}$ is very stable at about 380° C.

The standard test shows that the controlled wood stove according to an embodiment of the invention results in a reduction in fuel consumption of about 15-30%.

The controlled wood stove gives an ease of use with a more stable (i.e. less modulation) room temperature with less refills of wood. No or reduced chances of overheating and consequently a reduced risk of damage to the wood stove and therefore a longer life expectancy of the wood stove.

The controlled wood stove furthermore results in less build-up of soot in the wood stove and the chimney.

As for the environmental impact the controlled wood stove from a cold to a cold state showed emission reductions of about 60-80% again according to the norm EN 13240.

Besides the standard test circumstances (Laboratory Conditions) other normal and abnormal tests have been conducted. These other conditions include: "best user", "worst user", "bad chimney", "moist wood", and "wrong amount of wood". These conditions have been tested for different burn scenarios.

For comparison the un-controlled wood stove in the cases of a best user, worst user and bad chimney for nominal burn condition had efficiencies of 77.6%, 73.4%, and 61.3%, respectively.

For the controlled wood stove according to the invention, these efficiencies were 84.6%, 84.6%, and 80.1%, respectively.

The invention claimed is:

1. A method for burning a fuel in a wood stove having a door to a combustion chamber with a base, which combustion chamber is isolated from the air by an exhaust and an intake at which intake there is an air regulator having at least three valves, a primary valve connected via a primary air duct to regulate supply of primary combustion air to the combustion chamber through the base, a secondary valve connected via a secondary air duct to regulate supply of secondary combustion air to the combustion chamber between the base and the exhaust, and a tertiary valve connected via a tertiary air duct to supply tertiary combustion air to the combustion chamber at its upper end, wherein at least two of said three valves each are controlled by a burn controller configured to operate between the following states:

$0^{th}$ state; which is a cold start state of a burn of a fuel;
$1^{st}$ state; which is a warm start state of a burn of a fuel;
$2^{nd}$ state; which is a combustion state of a burn of a fuel;
$3^{rd}$ state; which is a glow state of a burn of a fuel; and
$4^{th}$ state; which is an off state;

wherein a shift from said each state, $0^{th}$, $1^{st}$ $2^{nd}$ $3^{rd}$, $4^{th}$ to any other said state, $0^{th}$, $1^{st}$ $2^{nd}$ $3^{rd}$, $4^{th}$ is provided according to a logic in the burn controller.

2. A method for burning a fuel in a wood stove having a door to a combustion chamber with a base, which combustion chamber is isolated from the air by an exhaust and an intake at which intake there is an air regulator having at least three valves, a primary valve connected via a primary air duct to regulate supply of primary combustion air to the combustion chamber through the base, a secondary valve connected via a secondary air duct to regulate supply of secondary combustion air to the combustion chamber between the base and the exhaust, and a tertiary valve connected via a tertiary air duct to supply tertiary combustion air to the combustion chamber at its upper end, wherein at least two of said three valves each are controlled by a burn controller configured to operate between the following states:

$0^{th}$ state; which is a cold start state of a burn of a fuel;
$1^{st}$ state; which is a warm start state of a burn of a fuel;
$2^{nd}$ state; which is a combustion state of a burn of a fuel;
$3^{rd}$ state; which is a glow state of a burn of a fuel; and
$4^{th}$ state; which is an off state);

wherein a state or a shift between each state is controlled according to exhaust measures provided by exhaust measure means or in inputs provided from a user interface means.

3. A method for burning a fuel in a wood stove having a door to a combustion chamber with a base, which combustion chamber is isolated from the air by an exhaust and an intake at which intake there is an air regulator having at least three valves, a primary valve connected via a primary air duct to regulate supply of primary combustion air to the combustion chamber through the base, a secondary valve connected via a secondary air duct to regulate supply of secondary combustion air to the combustion chamber between the base and the exhaust, and a tertiary valve connected via a tertiary air duct to supply tertiary combustion air to the combustion chamber at its upper end, wherein at least two of said three valves each are controlled by a burn controller configured to operate between the following states:

$0^{th}$ state; which is a cold start state of a burn of a fuel;
$1^{st}$ state; which is a warm start state of a burn of a fuel;
$2^{nd}$ state; which is a combustion state of a burn of a fuel;
$3^{rd}$ state; which is a glow state of a burn of a fuel; and
$4^{th}$ state; which is an off state;

wherein a state and/or a shift between each state are controlled according to an output from a door status means.

4. A method for burning a fuel in a wood stove having a door to a combustion chamber with a base, which combustion chamber is isolated from the air by an exhaust and an intake at which intake there is an air regulator having at least three valves, a primary valve connected via a primary air duct to regulate supply of primary combustion air to the combustion chamber through the base, a secondary valve connected via a secondary air duct to regulate supply of secondary combustion air to the combustion chamber between the base and the exhaust, and a tertiary valve connected via a tertiary air duct to supply tertiary combustion air to the combustion chamber at its upper end, wherein at least two of said three valves each are controlled by a burn controller configured to operate between the following states:

$0^{th}$ state; which is a cold start state of a burn of a fuel;
$1^{st}$ state; which is a warm start state of a burn of a fuel;
$2^{nd}$ state; which is a combustion state of a burn of a fuel;
$3^{rd}$ state; which is a glow state of a burn of a fuel; and
$4^{th}$ state; which is an off state;

wherein a state and/or a shift between each state are controlled according to an output from a door status means; and wherein the shift from one state to another state is activated from the $4^{th}$ state to the $0^{th}$ state: when a start instruction is given; at which time a timer is reset and started to give a time t;

from the $0^{th}$ state to the $0^{th}$ state: when a door open status is detected by the door status means;

from the $0^{th}$ state to the $1^{st}$ state: when a level of $O_2$ concentration in the exhaust decreases to below between 20% to 14%, and preferably about 15%;

from the $1^{st}$ state to the $1^{st}$ state: when a door open status is detected by the door status means;

from the $1^{st}$ state to the $2^{nd}$ state: when the T-measurement is above a Tset plus a T-offset, where the T-offset is between 0-50° C., and preferably about 5° C.; or when the primary valve is between 0 to 10%, and preferably about 0%;

from the $1^{st}$ state to the $3^{rd}$ state: when the time t is larger than between 5 to 20 min, and preferably about 15 min and the secondary valve is between 0 to 10%, and preferably about 0%;

from the $2^{nd}$ state to the $1^{st}$ state: when a door open status is detected by the door status means, or when the T-measurement is below $T_{set}$ minus a T-offset, where the T-offset is between 0-50° C., and preferably about 15° C.;

from the $2^{nd}$ state to the $3^{rd}$ state: when the time t is larger than between 5 to 20 min; and preferably about 15 min, and the secondary valve is between 0 to 10%, and preferably about 0%; from the $3^{rd}$ state to the $1^{st}$ state: when a door open status is detected by the door status means;

from the $3^{rd}$ state to the $4^{th}$ state: when the level of $O_2$ concentration in the exhaust increases to above between 14% and 20%, and preferably about 17.5%.

5. A wood stove having a door to a combustion chamber with a base, which combustion chamber is isolated from the air by an exhaust and an intake at which intake there is an air regulator having at least three valves, a primary valve connected via a primary air duct to regulate supply of primary combustion air to the combustion chamber through the base, a secondary valve connected via a secondary air duct to regulate supply of tertiary combustion air to the combustion chamber between the base and the exhaust, and a tertiary valve connected via a tertiary air duct to supply tertiary combustion air to the combustion chamber at its upper end, wherein at least two of said three valves each are controlled via an intake control by a burn controller that is configured to manage at least five burn states of the wood stove.

6. The wood stove according to claim 5 wherein the burn controller is connected to exhaust measure means comprising is at least a thermometer and/or a $O_2$-measuring device such as a λ-probe.

7. A method for producing a wood stove comprising the steps:

a wood stove is provided and prepared for installing:

an air regulator having at least one valve and preferably three valves and with a housing configured for fitting into a wood stove and configured for receiving control signals from a burn controller, which air regulator is fitted into the wood stove;

a burn controller comprising means for receiving inputs from exhaust measure means and/or a user interface and means for sending outputs to an air regulator, which outputs are generated by a burn control algorithm comprising a state machine with five burn states:

$0^{th}$ state; which is a cold start state of a burn of a fuel;

$1^{st}$ state; which is a warm start state of a burn of a fuel;

$2^{nd}$ state; which is a combustion state of a burn of a fuel;

$3^{rd}$ state; which is a glow state of a burn of a fuel;

$4^{th}$ state; which is an off state, which burn controller is fitted into the wood stove;

exhaust measure means are fitted to the wood stove or the chimney to the wood stove;

the air regulator is connected to the burn controller;

the exhaust measure means are connected to the burn controller; and providing a user interface and connecting the user interface to the burn controller.

* * * * *